US005172643A

United States Patent [19]

Koshida et al.

[11] Patent Number: 5,172,643

[45] Date of Patent: Dec. 22, 1992

[54] APPARATUS FOR HANDLING STRIPS OF PAPER

[75] Inventors: Yoshinori Koshida; Naohiro Yamada; Isao Miyake; Hiroyuki Tominaga, all of Tokyo, Japan

[73] Assignee: Oki Electric Industry Co., Ltd., Tokyo, Japan

[21] Appl. No.: 728,606

[22] Filed: Jul. 11, 1991

[30] Foreign Application Priority Data

| | | | |
|---|---|---|---|
| Jul. 16, 1990 | [JP] | Japan | 2-74316[U] |
| Jul. 26, 1990 | [JP] | Japan | 2-196124 |
| Aug. 3, 1990 | [JP] | Japan | 2-82233[U] |
| Aug. 24, 1990 | [JP] | Japan | 2-221017 |
| Nov. 20, 1990 | [JP] | Japan | 2-312928 |

[51] Int. Cl.[5] ..... G07G 5/00

[52] U.S. Cl. ..... 109/10; 109/24.1; 109/44; 109/66; 49/40

[58] Field of Search ..... 109/6, 7, 10, 14, 21, 109/24.1, 31, 38, 39, 44, 45, 64, 66, 70, 74, 69; 49/38–42

[56] References Cited

U.S. PATENT DOCUMENTS

| | | | |
|---|---|---|---|
| 2,338,309 | 1/1944 | Votypka | 49/40 X |
| 4,063,520 | 12/1977 | Parsons | 109/66 |
| 4,176,610 | 12/1979 | Markham et al. | 109/66 X |
| 4,275,667 | 6/1981 | Hilton | 109/44 |
| 4,457,444 | 7/1984 | Wold | 49/40 X |
| 4,489,662 | 12/1984 | Masachika | 109/66 |
| 4,540,106 | 9/1985 | Fukatsu | 109/24.1 X |
| 4,570,548 | 2/1986 | Martin et al. | 109/24.1 X |
| 4,603,835 | 8/1986 | deMey, III | 49/41 X |
| 4,695,171 | 9/1987 | Sapitowicz | 109/10 X |
| 4,918,660 | 4/1990 | Perrot | 49/40 X |

FOREIGN PATENT DOCUMENTS

| | | | |
|---|---|---|---|
| 436605 | 6/1948 | Italy | 49/40 |

*Primary Examiner*—Richard E. Moore
*Assistant Examiner*—Suzanne L. Dino
*Attorney, Agent, or Firm*—Edward D. Manzo; David K. Lucente

[57] ABSTRACT

An apparatus for handling strips of paper removably incorporated in paper strip handling equipment. The apparatus has a box having a window for handling strips of paper, a shutter section for opening and closing the window, a drum section having therein a pooling section for temporarily accommodating strips of paper, and an anti-intrusion portion provided on either one of opposite edges of the shutter section with respect to the opening and closing direction of the shutter for preventing a strip of paper, trash or similar alien substance from being inserted in the apparatus through a clearance formed between the box and the shutter section.

19 Claims, 21 Drawing Sheets

APPARATUS FOR HANDLING STRIPS OF PAPER

BACKGROUND OF THE INVENTION

1. Field of the Invention

The present invention relates to an apparatus for handling strips of paper and, more particularly, to a paper strip handling apparatus incorporated in automatic paper strip handling equipment which deals with strips of paper such as bills or bonds in a bank or similar banking facility or tickets in a transport facility.

2. Description of the Prior Art

A cash handling apparatus, for example, belongs to a family of paper strip handling apparatuses and is incorporated in automatic cash handling equipment. In a bank, for example, when the customer deposits by using the cash handling apparatus, the apparatus automatically checks bills put therein as to genuineness while determining the kind and the number of the bills. If the customer or operator has operated the equipment accurately and if the bills are genuine, the apparatus stores the bills in a safe also included in the equipment. When the customer has operated the equipment in a wrong sequence or inserted bills in an incorrect position in the apparatus, the apparatus returns the bills to the customer to urge the customer to operate the equipment all over again or to reinsert the bills in a correct position.

The above-described cash handling apparatus has an opening or window for inserting or refunding bills, and a shutter for selectively opening and closing the window. The shutter usually closes the window for protecting the apparatus from dust and trash and freeing the apparatus from mischievous acts. A pooling section is associated with the window for temporarily storing bills put in the apparatus by the customer. Whether or not the bills have been accommodated in the pooling section in a predetermined position is determined by sensors included in the pooling section.

A prerequisite with such a cash handling apparatus is that a clearance be provided between the shutter and the apparatus body to allow the shutter to open and close smoothly. The clearance is apt to admit trash and other alien substances and even bills into the apparatus therethrough, preventing the apparatus from operating completely or causing it to malfunction. Moreover, when the sensor fails to operate normally, it is likely that the shutter closes when bills are protruded from the window, bent or otherwise positioned in an incorrect condition. Then, the apparatus would proceed to the next processing step with the shutter catching the bills. While the number of sensors may be increased to eliminate this problem, such an approach is not practicable without increasing the cost of the apparatus.

SUMMARY OF THE INVENTION

It is therefore an object of the present invention to provide a paper strip handling apparatus which surely prevents trash and other alien substances from entering it through a clearance.

It is another object of the present invention to provide an inexpensive and compact paper strip handling apparatus capable of sensing paper strips accurately without resorting to an increase in the number of sensors.

In accordance with the present invention, an apparatus for handling strips of paper comprises a box formed with a window for handling strips of paper, a shutter section for opening and closing the window, a drum section having therein a pooling section for temporarily accommodating strips of paper, and an anti-intrusion portion provided on either one of opposite edges of the shutter with respect to the opening and closing direction of the shutter section and having an abutment surface for preventing an alien substance from being forcibly inserted in the apparatus through a clearance formed between the box and the shutter section.

The paper strip handling apparatus having the above construction is removably accommodated in cash handling equipment or similar equipment of the kind dealing with strips of paper.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Figure 1:
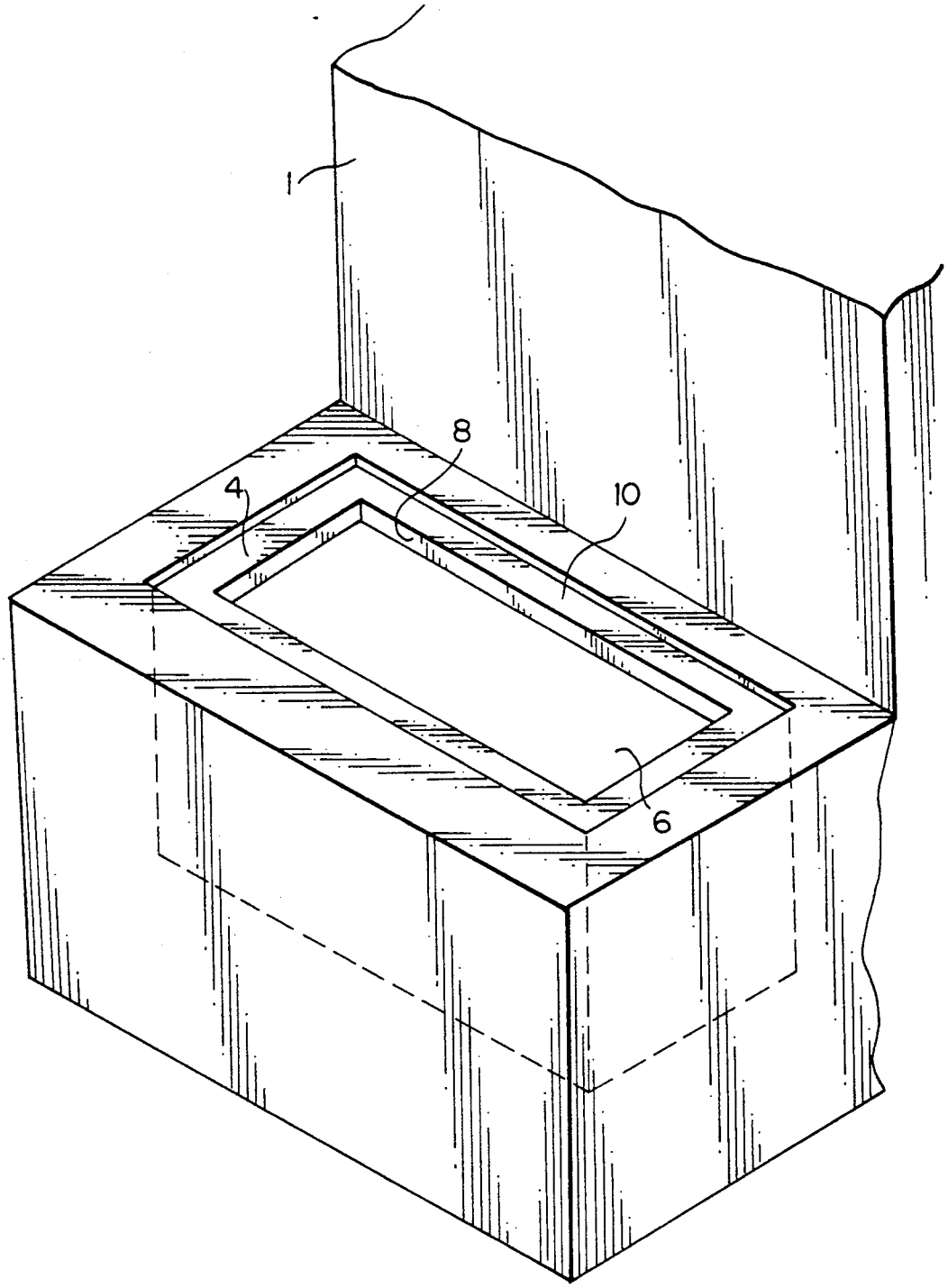
FIG. 1 is a perspective view showing the general construction of cash handling equipment implemented with a paper strip handling apparatus embodying the present invention.

Referring to FIGS. 2, 3, 4A, 4B, 5A, 5B, 7, 10A, 10B, 11A and 11B, a paper strip handling apparatus embodying the present invention is shown and generally designated by the reference numeral 2. In the illustrative embodiment, the apparatus 2 is implemented as an automatic cash handling apparatus by way of example. As shown, the apparatus 2 is generally made up of a box 4, a shutter section 6, and a drum section 7. The box 4 accommodates the shutter section 6 and drum section 7 therein and is removably disposed in automatic cash handling equipment 1. As the customer standing by the equipment 1 operates the apparatus 2 as guided by a CRT, not shown, provided on the equipment 1, the shutter section 6 and drum section 7 each performs predetermind operations.

Figure 13:
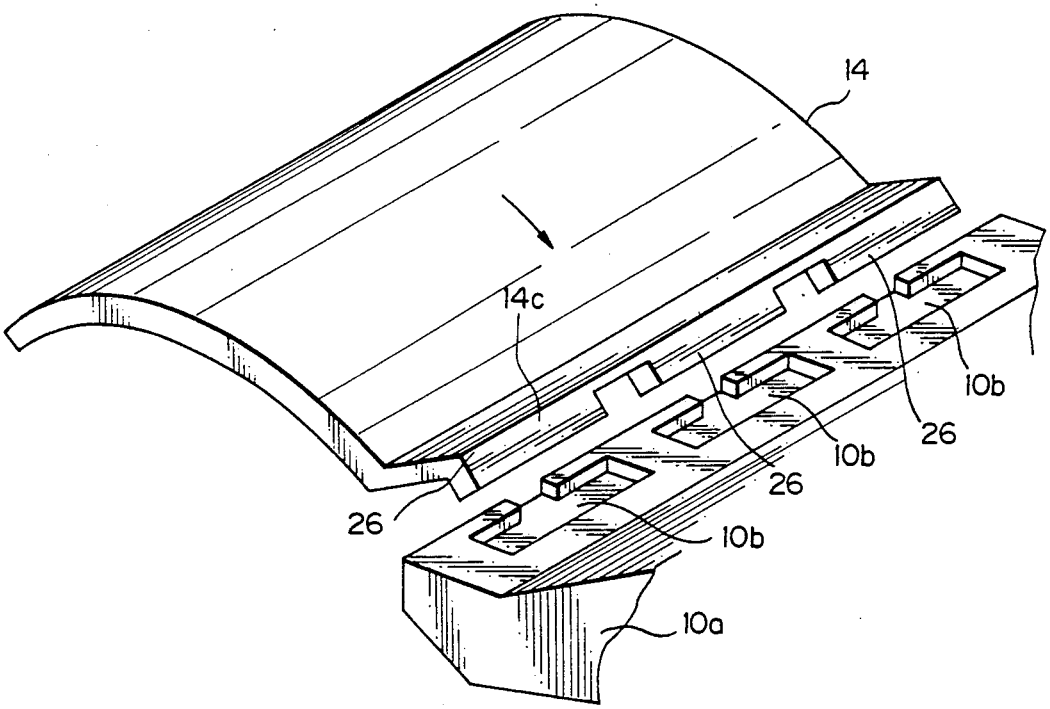
FIG. 13 is an enlarged fragmentary perspective view indicative of a relation between projections provided on one edge of a shutter body and recesses formed in a shutter stop.

As also shown in FIG. 1, the box 4 has a closed configuration except for part of the upper end and the entire rear end. Here, the terms "upper end" and the "rear end" refer respectively to the upper end and the left end of the box 4 as viewed in the figures. In the same sense, the terms "lower end", "front end" and "side walls" which will be mentioned should be understood to refer respectively to the lower end, the right end, and side walls facing each other in a direction perpendicular to the sheet surfaces of the figures. The open portion of the upper end 4*a* of the box 4 forms a window 8. The rear end of the box 4 which is entirely open implements the transport of bills between the apparatus 2 and a safe, not shown, which is also incorporated in the equipment 1. As also shown in FIGS. 1 and 13, the window 8 is surrounded by a frame 10 which has a shutter stop 10*a* at one edge or front edge thereof, as viewed from the customer's side. The shutter stop 10*a* is implemented as one or more recesses 10*b* positioned at spaced locations in the lengthwise direction of the frame 10. When a shutter 14 which will be described is closed, one edge 14*c* of the shutter 14, i.e., the leading edge with respect to the closing direction of the shutter 14, abuts against the shutter stop 10*a*. The frame 10 has a downward extension or penthouse 11 at the edge that faces the edge 14*c* of the shutter 12. When the shutter section 6 is mounted on the box 4, the shutter 14 moves into and out of the box 4 below the penthouse 11. A clearance 13 is formed between the penthouse 11 and the shutter 14 to allow the shutter 14 to open and close smoothly. The opposite side walls 4*b* and 4*c* of the box 4 support the shutter section 6 and drum section 7.

The shutter section 6 covers and uncovers the window 8 of the apparatus 2, as needed. Driven by a shutter drive mechanism 16, the shutter 14 is movable in the opening and closing directions over a generally rectangular opening 9 defined in the window 8, thereby opening and closing the opening 9. A shutter lock mechanism 17 locks the shutter 14 in a fully closed position. A shutter position sensing device 18 is responsive to the position of the shutter 14.

The shutter 14 is constituted by a shutter body 14*a* and a pair of arms 20*a* and 20*b*. The shutter body 14*a* has an arcuate cross-section as viewed in a plane perpendicular to the lengthwise direction thereof, and it appears generally rectangular as seen from the front. The shutter body 14*a* is sized slightly greater than the opening 9 of the window 8. An anti-intrusion portion 24 is formed at the center of the edge 14*b* of the shutter body 14*a* which is opposite to the edge 14*c*, i.e., the edge 14*b* with respect to the opening direction of the shutter 14. The anti-intrusion portion 24 has a hook-like cross-section and has a contact portion 22 at the end thereof. This portion 24 protrudes from the outer periphery of the shutter body 14*a* and extends in the lengthwise direction of the shutter body 14*a*. When the shutter 14 is closed, the tip of the contact portion 22 abuts against the rear or inner surface 11*a* of the penthouse 11 to prevent a paper strip such as a bill or trash from being forced into the apparatus 2 via the previously mentioned clearance 13. Projections 26 corresponding in number, size and configuration to the recesses 10*b* of the shutter stop 10*a* of the box 4 are provided on the front edge 14*c* of the shutter body 14*a*. When the shutter 14 is fully closed, the projections 26 each mates with respective one of the recesses 10*b*. A sensor 58 which will be described senses a condition wherein the projections 26 and recesses 10*b* have failed to accurately mate with each other, indirectly via the shutter lock mechanism 17. This prevents the window 8 from being fully closed with a bill or bills being caught by the shutter body 14*a*.

The arms 20*a* and 20*b* extend downward from substantially the center of opposite side edges of the shutter body 14*a* with respect to the lengthwise direction of the shutter body 14*a*. The arms 20*a* and 20*b* have respectively fulcrums 28*a* and 28*b* in close proximity to the lower ends thereof. Shafts 30*a* and 30*b* extend respectively from the fulcrums 28*a* and 28*b* away from each other, and each is rotatably received in a bearing, not shown, mounted on the side wall 4*b* or 4*c* of the box 4. Hence, the shutter body 14*a* is rotatably mounted on the box 4 via the arms 20*a* and 20*b*. A tension spring 34 is anchored at one end to the side wall 4*b* of the box 4 adjacent to the front end and at the other end to a hole 32 formed through the arm 20*a* at a position remote from the fulcrums 28*a*. The arm 20*a* is, therefore, constantly biased toward the front end of the box 4, i.e., in the closing direction of the shutter 14. As a result, the shutter 14 tends to rotate about the fulcrums 28*a* and 28*b* along the peripheral surface 68*a* of a drum 68 which will be described, closing an opening 64*a* formed in a pooling section 64 which will also be described. A stud 36 extends from substantially the center of the arm 20*a*. The shutter drive mechanism 16 is drivably connected to the shutter 14 via the stud 36 and a link 41 which is included in the shutter drive mechanism 16.

Figure 4A:
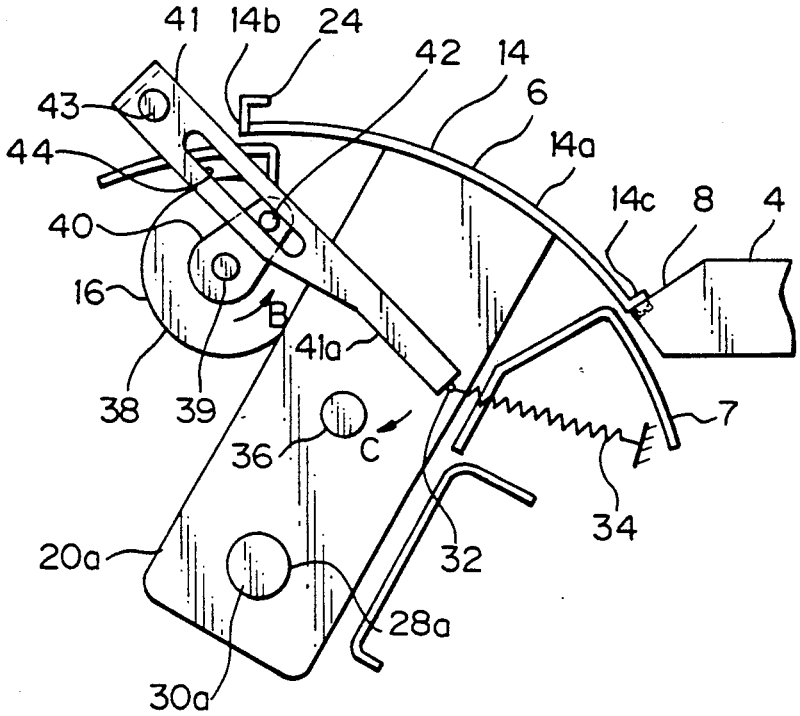
FIGS. 4A and 4B are side elevations showing a mechanism for opening and closing the shutter.
Figure 4B:
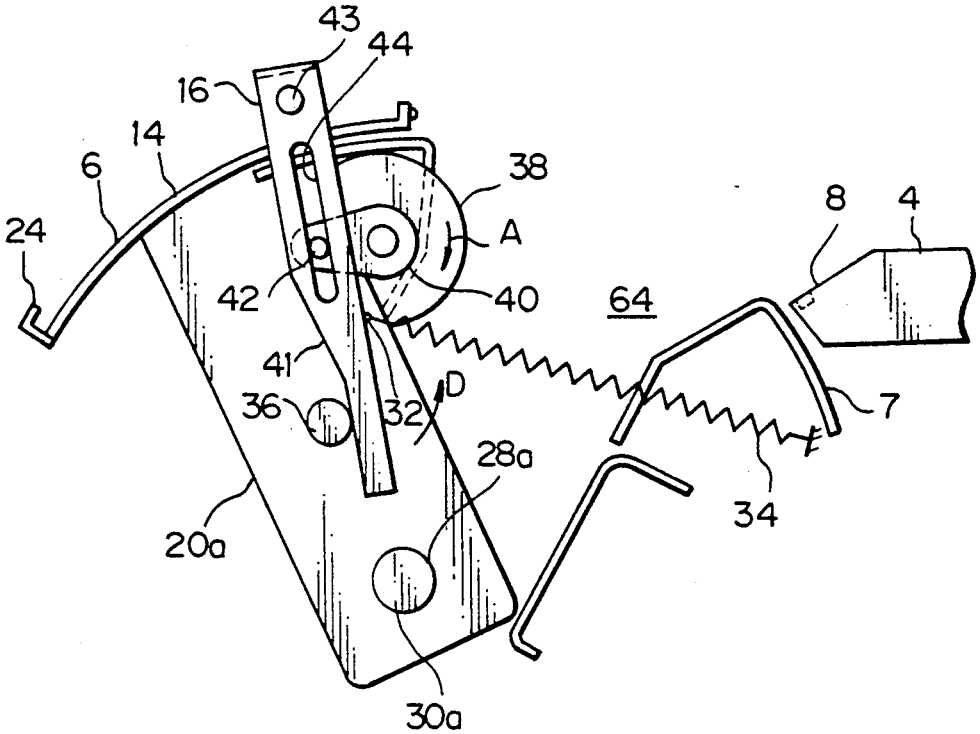

As best shown in FIGS. 4A and 4B, the shutter drive mechanism 16 has a motor 8, an oval cam plate 40 mounted on the output shaft 39 of the motor 38, and a link 41 engaged with the cam plate 40. The shutter drive mechanism 16 is mounted on the side wall 4*b* of the box 4 adjacently to the rear end of the latter with the arm 20*a* intervening between the mechanism 16 and the tension spring 34. A pin 42 is studded on the free end of the cam plate 40. The link 41 is implemented by a strip of metal and rotatable about a fulcrum 43 which is located above the motor 38. The link 41 has an edge 41*a* at the free end portion thereof which is slidable on the stud 36 of the arm 20*a*. An elongate slot 44 is formed in the link 41 to extend in the lengthwise direction of the link 41. The pin 42 studded on the cam plate 40 is movably received in the slot 44.

Figure 5A:
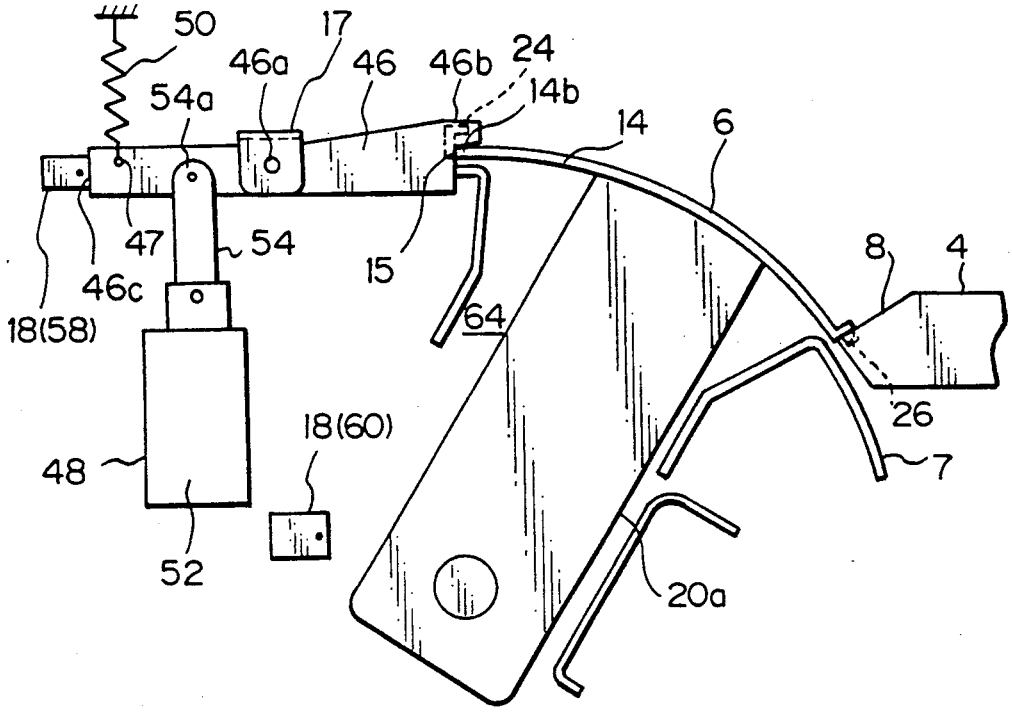
FIGS. 5A and 5B are side elevations showing a mechanism for locking and unlocking the shutter in a closed and an open position, respectively.
Figure 5B:
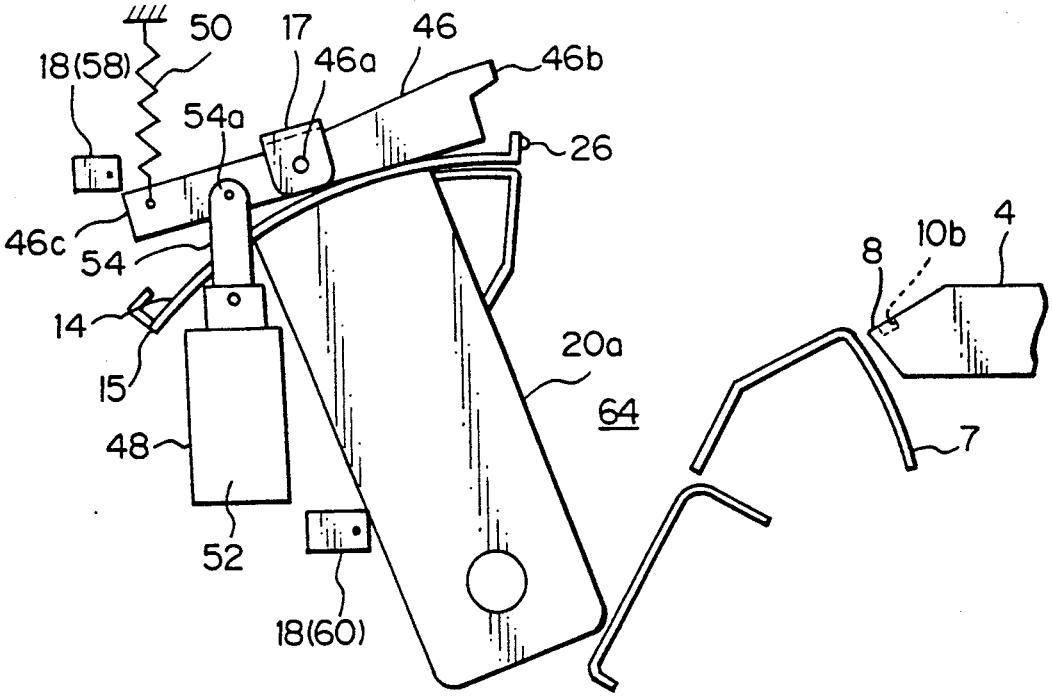
Figure 6:
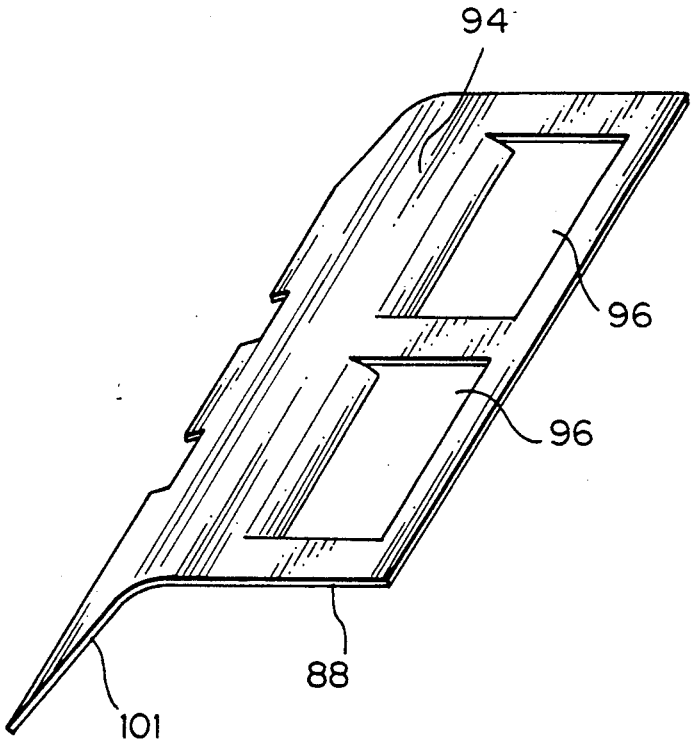
FIG. 6 is a perspective view of an under guide included in the embodiment.
Figure 7:
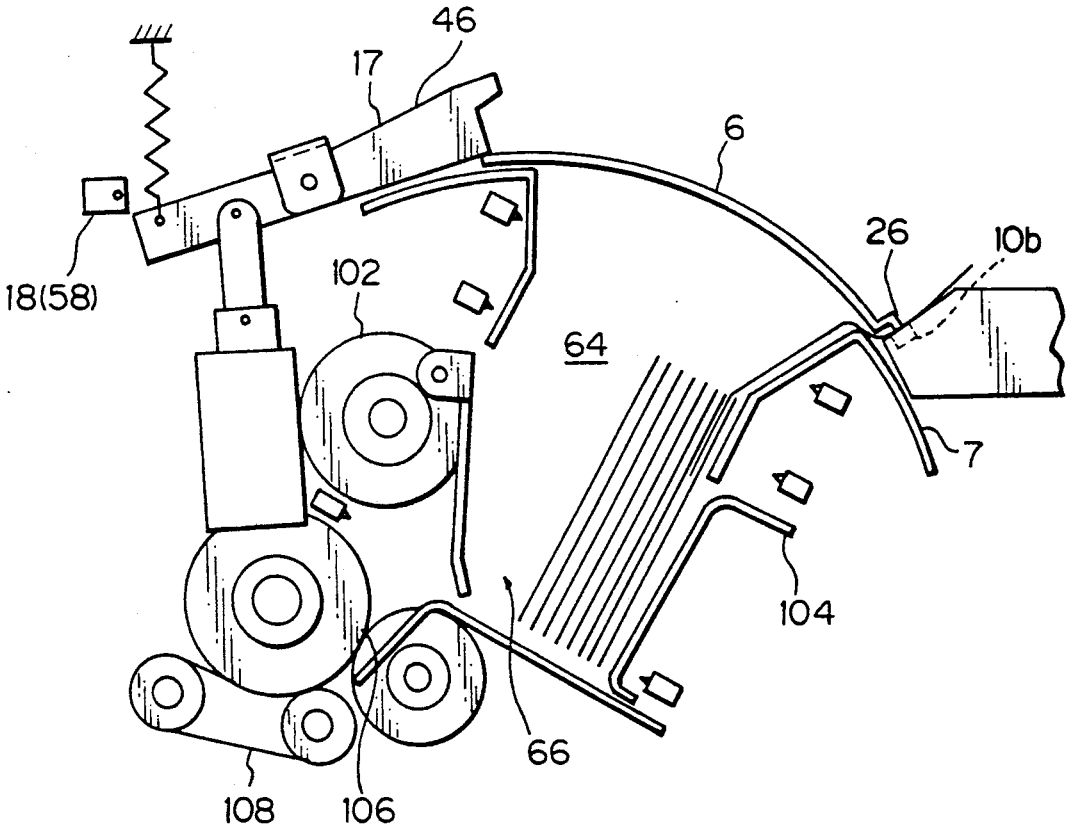
FIG. 7 is a side elevation showing the embodiment in another specific condition wherein bills are put in the apparatus in an irregular position.

As shown in FIGS. 5A and 5B in detail, the shutter lock mechanism 17 is mounted on the side wall 4*b* of the box 4 and positioned at the opposite side to the customer expected to stand by the equipment 1 with respect to the drum section 7 and slightly above the axis of rotation of the drum section 7. The shutter lock mechanism 17 has a shutter lock 46 and a solenoid assembly 48. As also shown in FIG. 7, the shutter lock 46 has a prismatic configuration and has an abutment 46*b* at one end thereof. When the portion 15 of the edge 14*b* of the shutter body 14*a* where the anti-intrusion portion 24 is absent abuts against the abutment 46*b*, the shutter lock 46 locks the shutter 14 in the closed position to prevent it from being forced to open from the outside. The shutter lock 46 has a fulcrum 46*a* at substantially the center thereof and is mounted on the box 4 to be rotatable about the fulcrum 46*a*. A tension spring 50 is retained at one end by the upper wall 4*a* of the box 4 and at the other end by a hole 47 formed in the end 46*c* of the shutter lock 46 at the opposite side to the abutment 46*b*, constantly biasing the shutter lock 46 clockwise as viewed in FIG. 5A.

The solenoid assembly 48 has a solenoid 52 and a plunger 54 which is movable into and out of the solenoid 52. The free end of the plunger 54 is drivably connected to the shutter lock 46 at the intermediate between the fulcrum 46*a* and the hole 47 of the latter. When the solenoid 52 is energized, it pulls the plunger 54 to cause the shutter lock 46 to rotate about the fulcrum 46*a* clockwise, as viewed in FIG. 5B, against the action of the tension spring 50. As a result, the abutment 46*b* of the shutter lock 46 is moved away from the portion 15 of the shutter body 14*a*, whereby the shutter 14 is unlocked. Conversely, when the solenoid 52 is deenergized, the plunger 54 protrudes from the solenoid 52 with the result that the shutter lock 46 rotates clockwise about the fulcrum 46*a* due to the action of the spring 50 while pulling the plunger 54 upward. Consequently, the shutter lock 46 locks the shutter 14 in the closed position by the abutment 46*a* thereof.

The shutter position sensing device 18 has sensors 58 and 60 and is mounted on the side wall 4*b* of the box 4 by suitable supporting means. The sensor 58 senses the above-stated locked condition, i.e., closed position of the shutter 14. Specifically, the sensor 58 is located such that the end 46*c* of the shutter lock 46 remote from the abutment 46*b* faces it when the shutter 14 is fully closed. When the end 46*c* of the shutter lock 46 is brought to the position where it faces the sensor 58, the sensor 58 turns on to determine that the shutter 14 has been locked, i.e., the closing movement of the shutter 14 has completed. The other sensor 60 determines that the shutter 14 is open on sensing the arm 20*a* of the shutter 14. The sensor 60 is located in the vicinity of the lower end of the arm 20*a* so as to sense the arm 20*a* when the shutter 14 is fully opened. The sensor 60 turns on when it senses the arm 20*a*, i.e., the end of the opening movement of the shutter 14.

The shutter 14 is opened and closed and locked and unlocked, as follows. To open the shutter 14 held in the closed position shown in FIGS. 4A and 5A, control means, not shown, energizes the solenoid 52 which then pulls the plunger 54. The plunger 54 in turn pulls the shutter lock 46 against the action of the tension spring 50, causing the shutter lock 46 to rotate counterclockwise about the fulcrum 46*a*. As a result, the abutment 46*b* of the shutter lock 46 is released from the portion 15 of the shutter body 14*a* to unlock the shutter 14. Subsequently, the above-mentioned control means rotates the motor 38 of the shutter drive mechanism 16 in a direction indicated by an arrow B in FIG. 4A. This causes the link 41 to rotate in a direction indicated by an arrow C. Then, the slidable edge 41*a* of the link 41 abuts against the stud 36 of the arm 20*a*. Sliding on the stud 36, the edge 41*a* of the link 41 urges it toward the rear end of the box 4 overcoming the force of the tension spring 34. As a result, the arms 20*a* and 20*b* of the shutter 14 are rotated counterclockwise about their fulcrums 28*a* and 28*b*, so that the shutter 14 starts opening at a speed corresponding to the rotation speed of the motor 38. As the sensor 60 senses the arm 20*a*, i.e., the open position of the shutter 14, the motor 38 and solenoid 52 are deenergized at the same time. In this condition, the upper surface of the shutter body 14*a* contacts the lower surface of the shutter lock 46 and thereby prevents the shutter lock 46 from rotating clockwise against the action of the spring 50. The sensor 58 is not turned on since the end 46*c* of the shutter lock 46 is not aligned with the sensor 58.

The shutter 14 held in the open position shown in FIGS. 4B and 5B is closed by the following procedure. First, the motor 38 is rotated in a direction indicated by an arrow A in FIG. 4B. Then, the link 41 starts rotating in a direction indicated by an arrow D. Since the arm 20*a* is constantly biased in the closing direction by the tension spring 34, the arm 20*a* and, therefore, the shutter 14 is bodily moved in the closing direction with the stud 36 sliding on the edge 41*a* of the link 41. At this instant, the solenoid 52 is not energized. This, coupled with the fact that the shutter lock 46 is biased clockwise about the fulcrum 46*a* by the spring 50, causes the shutter 14 to rotate with the upper surface of the shutter body 14*a* sliding on the lower surface of the shutter lock 46. On completing the closing movement, the shutter 14 abuts against the shutter stop 10*a* at the edge 14*c* thereof. Subsequently, the control means deenergizes the motor 38 and thereby stops the movement of the link 41. At the same time, the abutment 46*b* of the shutter lock 46 and the portion 15 of the shutter 14 are brought into engagement in an instant by the force of the spring 50, locking the shutter 14 in the closed position. As the sensor 58 senses the locked state of the shutter 14, the operation for closing the shutter 14 is terminated. In such a closed position, the shutter 14 will not readily open even when unexpected forces are applied thereto from the outside.

The drum section 7 has a hollow cylindrical configuration and is made up of a drum body 62, a pooling section 64, and a bill transporting device 66. Accommodating the pooling section 64 and bill transporting device 66 therein, the drum body 62 has a generally cylindrical hollow drum 68 formed by machining a rectangular sheet of iron, and flanges 70 and 71 holding the drum 68 therebetween. Shafts 70*a* and 71*a* extend out from the flanges 70 and 71, respectively, and align with each other when the drum 68 is held between the flanges 70 and 71. The drum section 7 is journalled to the opposite side walls 4*b* and 4*c* of the box 4 by the shafts 70*a* and 71*a*. The flange 70 has gear teeth 72*a* on the circumferential edge 72 thereof. A pinion gear 76 is held in mesh with the gear teeth 72*a* and driven by a stepping motor, not shown. In this configuration, the rotation of the stepping motor is transmitted to the drum 68 via the pinion gear 76 and gear teeth 72*a*. A stop 78 extends radially outward from the circumferential edge 72 of the flange 70. While the drum section 7 is rotatable in a direction indicated by an arrow I in FIG. 10B, the stop 78 limits the rotation as it abuts against a post 80 which extends from a predetermined position of the box 4. When a rectangular sheet of iron is shaped to form the hollow drum 68, opposite edges of the rectangular sheet are not joined together. Specifically, the opposite edges are spaced apart from each other by a predetermined distance and bent into the drum 68 over a predetermined width each, thereby forming guides 82*a* and 82*b* which constitute part of the pooling section 64. Although not shown in the figures, a slot is formed in the drum 68 to allow bills to be transported between the pooling section 64 and the safe of the automatic cash handling equipment 1.

The above-mentioned stepping motor is so controlled as to move the drum section 7 to any one of three different positions, i.e., (a) a transaction position for allowing the customer to deposit or draw out, (b) a separation position for separating bills put in the pooling section 7 in order to feed them to a bill transporting device, and (c) a reception position for allowing bills from the safe of the equipment 1 to enter the pooling section 64 to be repaid to the customer.

The pooling section 64 has a box-like configuration which is open in a generally rectangular shape at the upper end thereof and substantially closed at the bottom, front and rear ends, and opposite sides. Specifically, the front and rear ends are closed by the guides 82*a* and 82*b* and a bill transporting device 86, the opposite sides are closed by the flanges 70 and 71, and the bottom is closed by an under guide 88 which will be described. The pooling section 64 accommodates bills put in by the customer or bills transported from the safe of th equipment 1 to be repaid to the customer. Sensors 90*a*, 90*b* and 91 are provided for determining whether or not bills are present in the pooling section 64. Specifically, a pair of sensors 90*a* and a pair of sensors 90*b* each is located at laterally spaced positions at the upper end of the pooling section 64, while a pair of sensors 91 are located in a lower portion and at the center of the pooling section 64. Further, a pair of sensors 92*a* and a pair of sensors 92*b* are responsive to the irregularity in the position of bills, and each is located at laterally spaced positions adjacently to the opening of the pooling section 64. When the sensors 92*a* and 92*b* detect some irregularity in the position of bills, a message is produced from a loudspeaker, not shown, or displayed on a CRT or similar display to urge the customer to reposition the bills.

The under guide 88 is constituted by a sheet of metal in the form of a letter L and having substantially the same length as bills. The under guide 88 has a major surface 94 which is the longer side of the letter L. Bills are put on the major surface 94 in an upright and horizontally long position. Elongate slots 96 are formed through the major surface 94, and a tray 100 is disposed below the under guide 88. Even when coins or similar alien substances 98 are introduced in the pooling section 64 by accident, they drop onto the tray 100 via the slots 96 of the under guide 88. The shorter portion of the letter L constitutes an auxiliary plate 101 for facilitating the movement of bills from the pooling section 64 to a mechanism which prevents a plurality of bills from being fed together, i.e., an anti-overlap mechanism as will be described.

The bill transporting device 66 separates bills 97 put in the bill pooling section 64 one by one and sequentially transports them to the safe of the equipment 1. The transporting device 66 has a picker roller section 102, a bill presser 104, an anti-overlap mechanism 106 for preventing two or more bills from being fed together as mentioned above, and a transport path 108.

The picker roller section 102 has a plurality of picker rollers 110 (only one is shown) for sequentially picking up the bills 97 accommodated in the pooling section 64 and feeding them to the anti-overlap mechanism 106, and a center guide 112 for preventing the substances 98 other than bills from entering the anti-overlap mechanism 106.

The center guide 112 is located at the bill presser 104 side with respect to the picker rollers 110 and implemented by a rectangular metallic plate which is as long as or slightly longer than the bill of maximum size in circulation. The center guide 112 has shafts 114 (only one is shown) at opposite sides of one edge thereof with respect to the widthwise direction and has studs 116 (only one is shown) at opposite sides of the other edge. The shafts 114 are respectively rotatably supported by supports, not shown, which are mounted on the flanges 70 and 71, whereby the center guide 112 is rotatably supported within the drum 68. Tension springs 118 (only one is shown) are anchored at one end to the flanges 70 and 71 and at the other end to the studs 116 so as to constantly bias the studs 116 toward the flanges 70 and 71. Therefore, the center guide 112 is constantly biased clockwise, as viewed in FIG. 3, about the shafts 114 by the tension springs 118. A stop 120 is provided for limiting the clockwise movement of the center guide 112. When the center guide 112 is restricted by the stop 120, it defines or uncovers an opening 107 so that bills accommodated in the pooling section 64 may be sequentially fed out to the anti-overlap mechanism 106 via the opening 107. The center guide 112 is formed with the same number of holes 75 as the picker rollers 110. The positional relation between the picker rollers 110 and the center guide 112 and the size of the holes 75 are selected such that the picker rollers 65 each may partly protrude into the pooling section 64 through respective one of the holes 75. Before the bills 97 are pressed against the picker rollers 110 by the bill presser 104, the center guide 112 is constantly pulled toward the bill presser 104, as will be described. In this position, the center guide 112 blocks the opening 107 contiguous with the anti-overlap mechanism 106 so as to prevent coins or similar alien substances from entering the mechanism 106. Even when such alien substances enter the mechanism 106 by accident, they drop through the slots 96 of the under guide 88 to be received by the tray 100, as stated earlier. This successfully sets up a double countermeasure against troubles ascribable to the entry of substances other than bills.

The bill presser 104 shifts the bills 97 put in the pooling section 64 by the customer toward the picker roller section 102 and presses the bills 97 against the picker rollers 110 by a predetermined force so that the bills 97 may be sequentially fed to the anti-overlap mechanism 106 by the picker rollers 110. For this purpose, the bill presser 104 has a bill pressing section 122 and a drive section 124. The bill presser 104 is interposed between the guides 82*a* and 82*b* and the under guide 88 together with the picker roller section 102, forming part of the side wall of the pooling section 64. The bill presser 104 is located to face the picker roller section 102 such that the bills 97 put in the pooling section 67 by the customer are positioned between the picker roller section 102 and the bill presser 104. Before the bills 97 are put in the pooling section 67, the bill presser 104 is spaced apart from the picker roller section 102 to await the entry of the bills 97. This position of the bill pressure 104 will hereinafter be referred to as a stand-by position.

The bill pressing section 122 has a main plate 126, a pair of brackets 128 (only one is shwon), and a bracket 130. The main plate 126 is implemented by a plate of metal having a rectangular major surface 127 which is substantially the same in size with the center guide 112. The brackets 128 each is a generally L-shaped side plate affixed to the surface 126*a* of the main plate 126 adjacently to the picker rollers 110 and at opposite sides of the main plate 126 with respect to the lengthwise direction of the main plate 126. Each L-shaped bracket 128 has an abutment 129*a* at the free end thereof which is engageable with associated one of the studs 116 of the center guide 112. A hole 129*b* is formed through the abutment 129*a* of each bracket 128. Tension springs 83 each is anchored at one end to the flange 70 or 71 and at the other end to associated one of the holes 129*b* of the brackets 128, constantly biasing the bill presser 104 toward the picker rollers 110. The bracket 130 extends out from the center of the surface 126*b* of the main plate 126 which is opposite to the surface 126*a*. The bracket 130 operatively connects the bill pressing section 122 to the drive section 124 via a stud 130*a* which is provided on the free end of the bracket 130. The drive section 124 has a motor 132, a cam plate 134 mounted on the output shaft 132*a* of the motor 132, and a link 136 engaged with the cam plate 134. Having an oval configuration, the cam plate 134 is mounted on the output shaft 132*a* of the motor 132 and provided with a pin 134*a* at the other end thereof. The link 136 is a strip of metal having a fulcrum 136*a* at one end thereof. The pin 134*a* of the cam plate 134 is received in an elongate slot 136*b* formed in the link 136 at substantially the center of the latter. The free end portion of the link 136 is configured as a slidable portion 136*c* which is slidable on the stud 130*a* of the bracket 130 as the link 136 is rotated about the fulcrum 136*a*.

In the above construction, as control means, not shown, drives the motor 132 and, therefore, the cam plate 134, the pin 134*a* received in the slot 136*a* of the link 136 moves in a circular motion and, therefore, moves in a reciprocating motion in the slot 136*a*. As a result, the link 136 is caused to move about the fulcrum 136*a* in a reciprocating motion over a predetermined range. At this instant, the slidable portion 136*c* and stud 130*a* are engaged with each other, and the tension springs 83 (only one is shown) constantly bias the bill pressing section 122 toward the rear end of the box 4. Hence, the bill pressing section 122 is driven by the motor 132 to move toward and away from the picker roller section 102, as indicated by an arrow in FIG. 3. The extreme points which delimit the above-mentioned predetermined range are so set as to represent respectively the open position and the closed position of the shutter 14. Sensors 138*a* and 138*b* are located at predetermined positions inside the drum 68 which correspond to the extreme points of the predetermined range. The sensors 138*a* and 138*b* each determines whether or not the link 136 has arrived at associated one of the extreme points. As either one of the sensors 138*a* and 138*b* determines that the link 136 has arrived at the associated extreme point, the motor 132 included in the drive section 124 is deenergized. The rotation of the motor 132 is interlocked with the drive of the motor 38.

The anti-overlap mechanism 106 prevents two or more of the bills 97 from being fed together to the transport path 108 while overlapping each other, as stated earlier. Disposed below the picker roller section 102, the anti-overlap mechanism 106 has a feed roller 140 having substantially the same length as the center guide 112, and a reverse roller 142 identical in length with the feed roller 140 and simply helping the feed roller 140 transport the bills 97. The feed roller 140 is driven by a drive source, not shown. The feed roller 140 and reverse roller 142 are pressed against each other to drive the bill therebetween toward the transport path 108. The peripheral surface 140*a* of the feed roller 140 is suitably machined or treated so that a greater frictional force may act between the roller surface 140*a* and the bill 97 than between the adjoining bills 97. In such a configuration, when two or more bills 97 are fed together to between the feed roller 140 and the reverse roller 142, the feed roller 140 feeds only one of them which contacts it since the frictional force acting between the roller 140 and the bill is greater than the frictional force acting between the adjoining bills. If desired, the reverse roller 142 and feed roller 140 may be spaced apart from each other by a gap which is smaller than the thickness of a single bill, and the reverse roller 142 may be driven independently of and in the opposite direction to the feed roller 140. Then, the reverse roller 142 will exert a force on the bill contacting it in the opposite direction to the direction in which the feed roller 140 feeds the bill, further enhancing the anti-overlap effect.

The transport path 108 transports the bills 97 sequentially coming out of the anti-overlap mechanism 106 to the safe of the equipment 1. The transport path 108 is defined by a conveyor in the form of an endless belt 144. A sensor 146 is disposed on the transport path 108 for counting the bills 97 and monitoring the distance between the successive bills 97. The belt 144 is positioned below and in contact with the feed roller 140. The bills 97 are transported from the inside to the outside of the drum 68 by the belt 144 and then routed through another transport path, not shown, which terminates at the safe of the equipment 1.

Figure 8A:
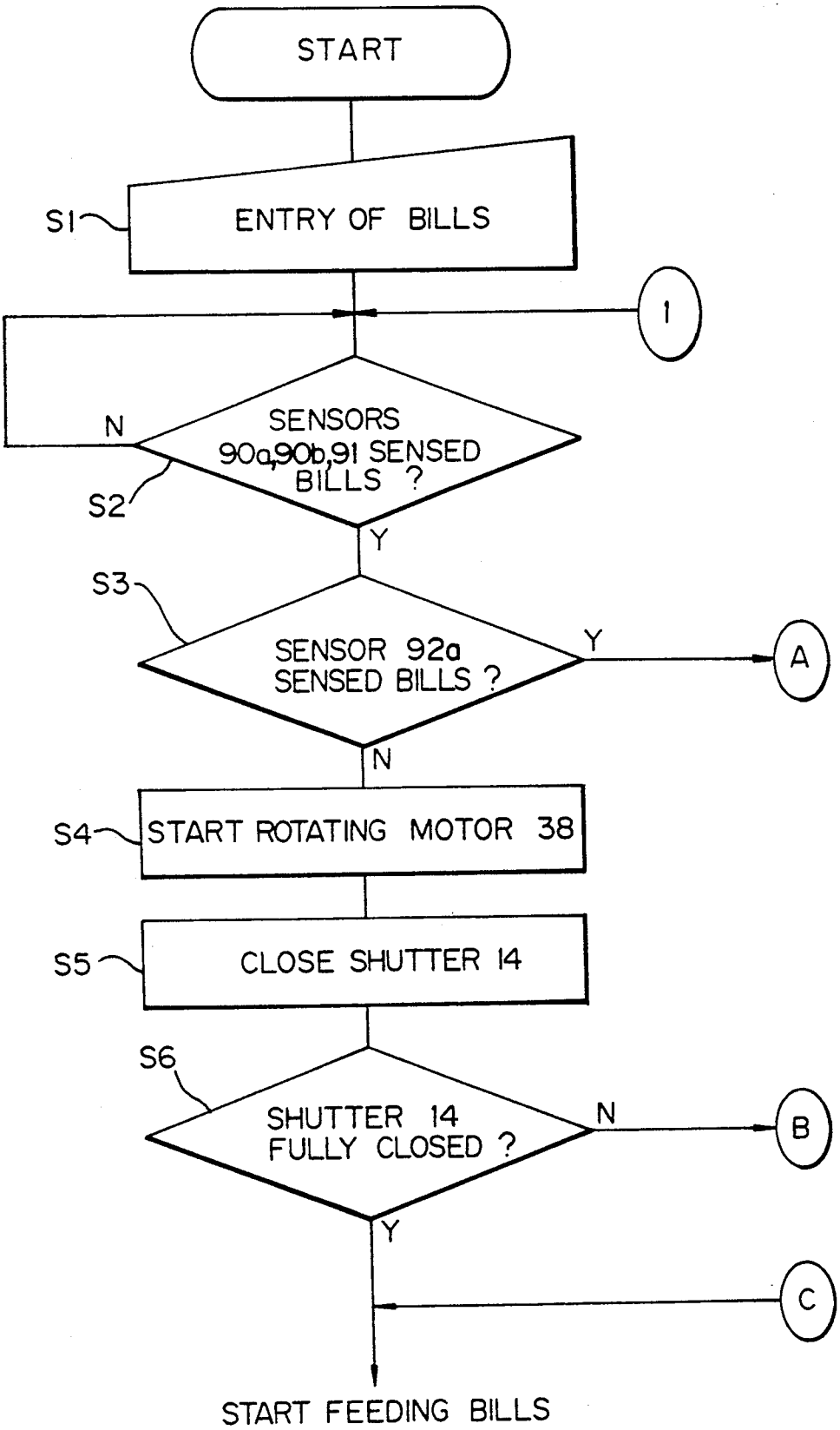
FIGS. 8A, 8B and 8C are flowcharts demonstrating specific procedures for feeding bills to an anti-overlap mechanism also included in the embodiment.
Figures 8B, 8C:
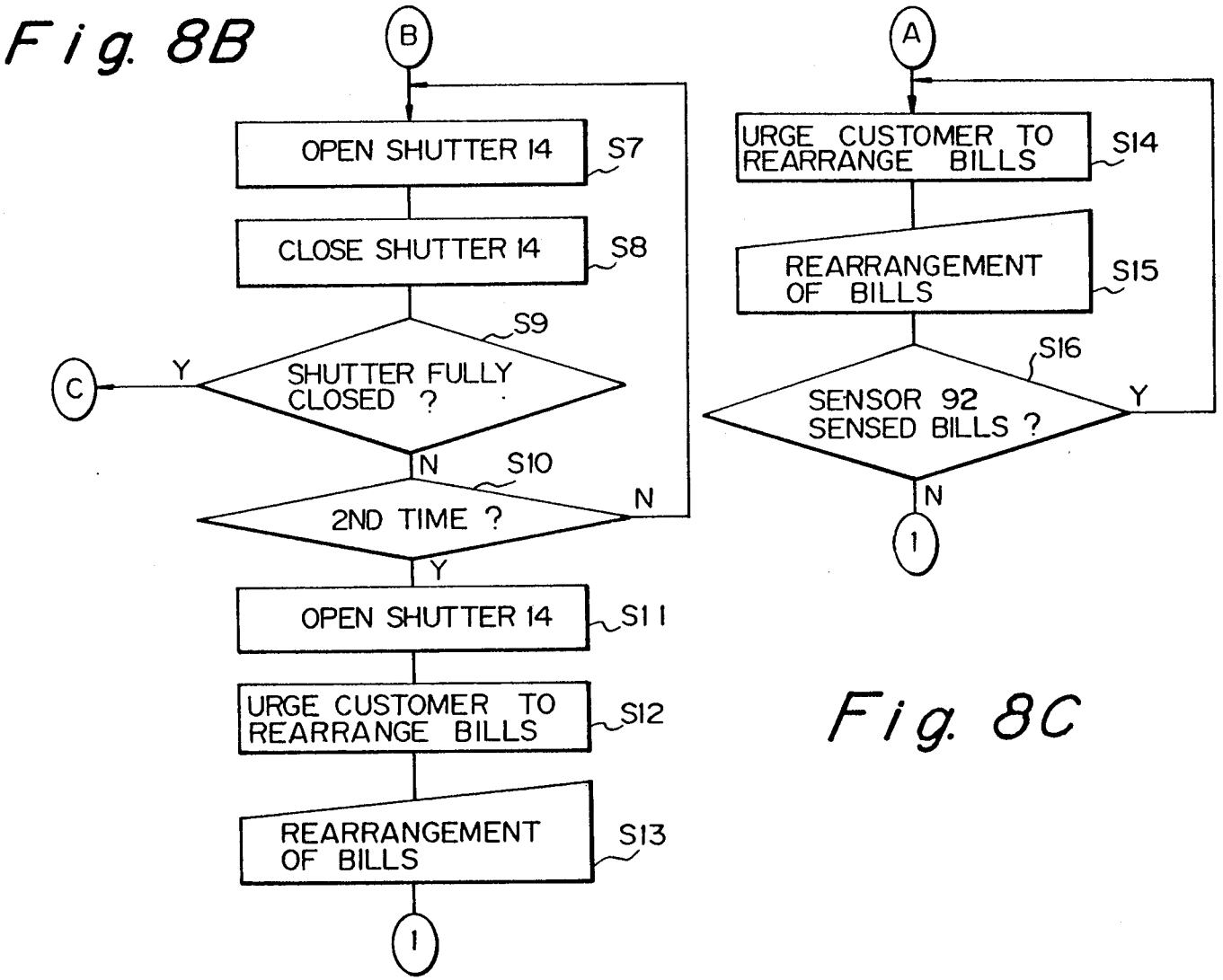
Figure 9:
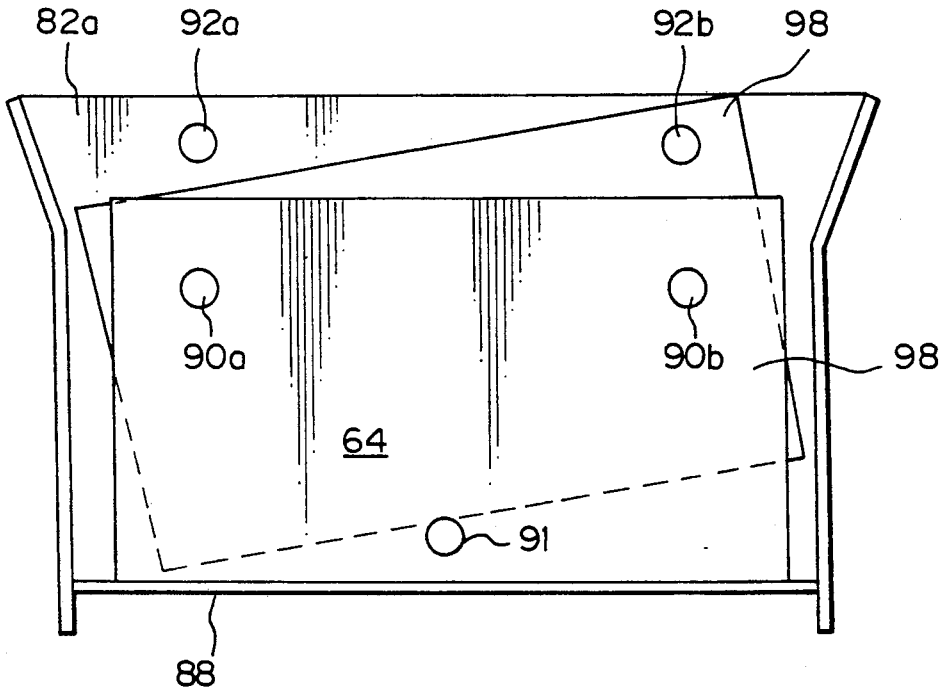
FIG. 9 shows the arrangement of sensors included in the embodiment for sensing bills put in a pooling section.

A reference will be made to FIGS. 8A, 8B and 8C for describing a procedure in which the cash handling apparatus 2 of the present invention handles bills. To begin with, the customer operates the cash handling equipment 1 (START) to open the window 8, and then puts the bills 97 in the pooling section 64 (step S1). Assume that the sensor pairs 90*a*, 90*b* and 91 have sensed the bills 97 in the pooling section 64 (S2), and that the sensor pair 92*a* has determined that the bills 97 in the pooling section 64 have been neatly positioned in a predetermined position (S3). Then, the motor 38 is energized (S4) to start moving the shutter 14 in the closing direction (S5). As soon as the leading edge 14*c* of the shutter 14 with respect to the closing direction abuts against the shutter stop 10*a*, the lugs 26 provided on the edge 14*c* each mates with respective one of the recesses 10*b* formed in the shutter stop 10*a*. In this manner, the shutter 14 is fully closed and then locked in position. The sensor 58 determines whether or not the shutter 14 has been fully closed (S6). If the answer of the step S6 is positive, Y, the program causes the bill transporting device 66 to perform the previously stated operations.

Assume that the shutter 14 has starting closing despite that the position of the bills put in the pooling section 64 are not regular and, as a result, the lugs 26 and recesses 10*b* have mated with each other with one or more of the bills intervening therebetween, as shown in FIG. 7. Then, the sensor 58 does not detect the closed position of the shutter 14, so that the operation is transferred from the step S6 to a step S7 for executing a retry sequence. It is to be noted that whether or not the shutter 14 has been fully closed is determined on the basis of whether or not the closing movement of the shutter 14, step S5, has ended in a predetermined period of time.

Figure 2:
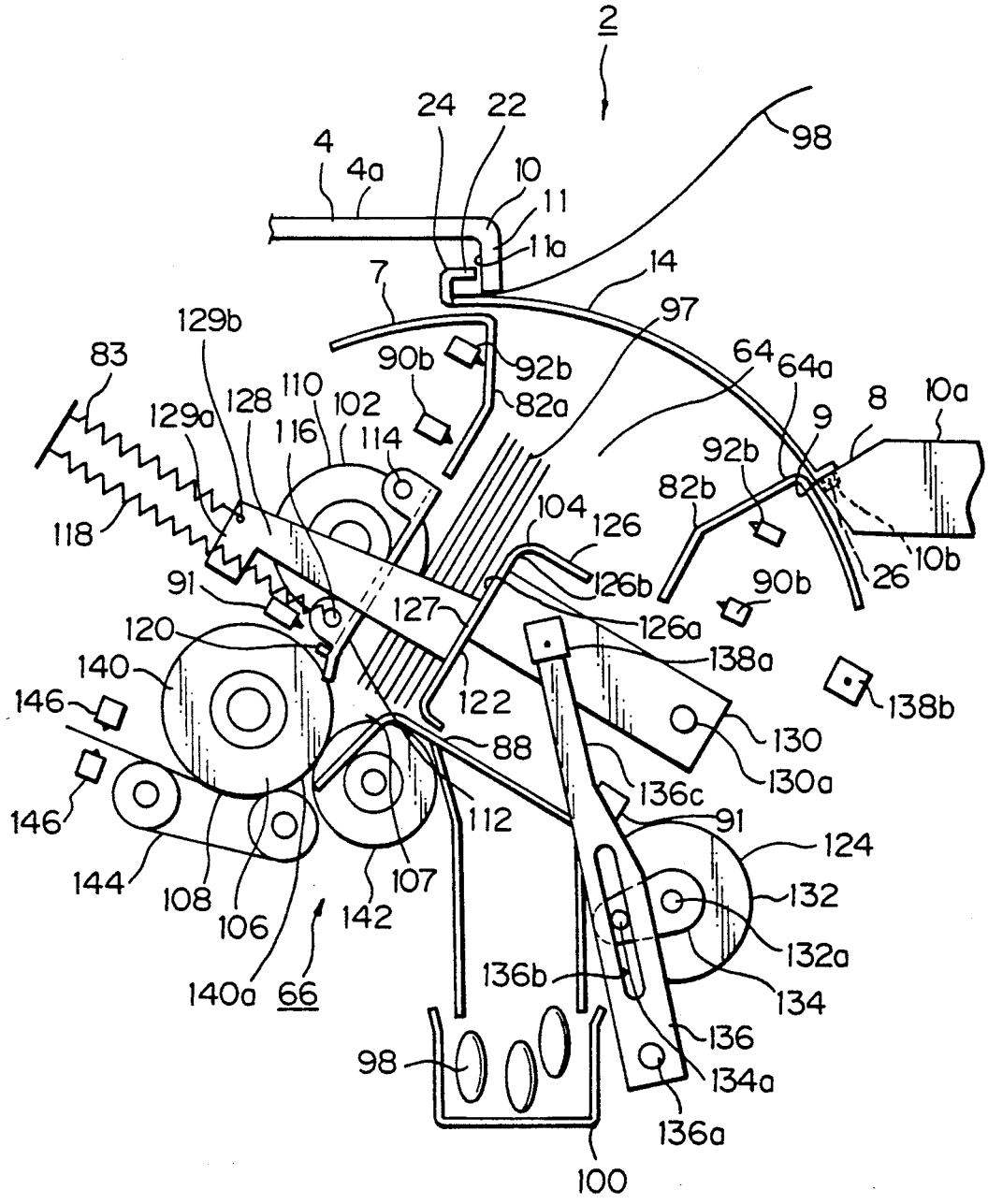
FIG. 2 is a side elevation showing the embodiment in a specific condition wherein a bill is prevented from entering the apparatus by an anti-intrusion portion after a shutter has been closed.
Figure 3:
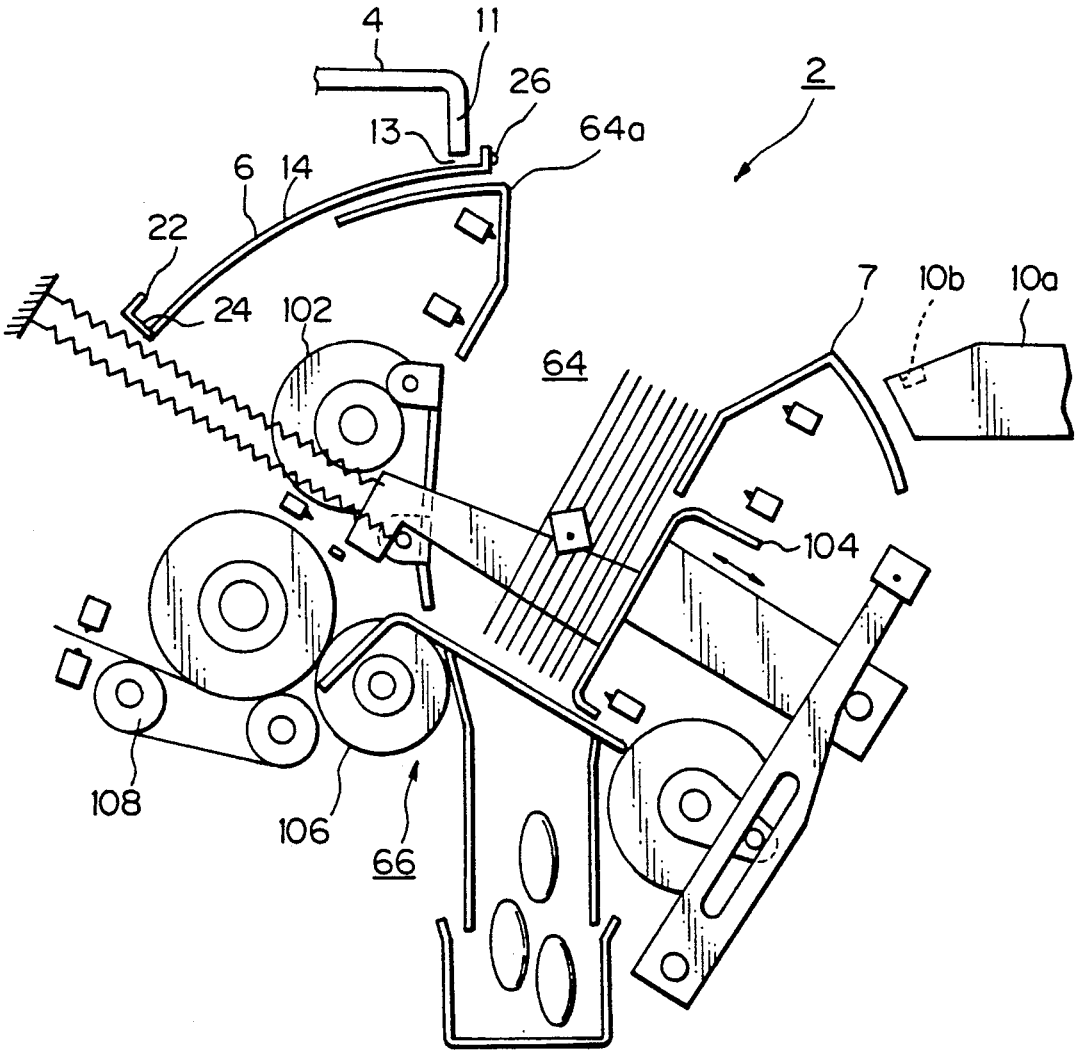
FIG. 3 is a view similar to FIG. 2, showing the shutter in an open position.

It is noteworthy that in the closed position of the shutter 14 the abutment 22 of the hook-like portion 24 abuts against the rear or inner surface of the extension or penthouse 11 of the box 4. Hence, as shown in FIG. 2, a strip of paper such as a bill or trash which may be inserted into the clearance between the shutter 14 and the box 4 either intentionally or unintentionally is intercepted blocked by the hook-like portion 24.

In the above-mentioned retry sequence, the shutter 14 once brought to the closed position is opened (S7) and then closed again (S8). Then, the step S6 is executed again (S9), and whether or not the shutter 14 has been fully closed is determined (S10). If the sensor 58 again fails to sense the closed position of the shutter 14 (Y, S10), the shutter 14 is opened (S11) and a message for urging the customer to rearrange the bills is produced via a speaker, not shown, or displayed on a CRT or similar display (S12). As the customer rearranges the bills as instructed by the message (S13), the program returns to the step S2 for repeating the handling procedure.

If some of the bills in the pooling section 64 are irregularly positioned as determined by the sensor pair 92*a* in the step S3, a message is also imparted to the customer via the loudspeaker or the display to urge the customer to reposition the bills (S14). As the customer repositions the bills (S15), the sensor pairs 92*a* again determines whether or not the bills are neatly arranged in a predetermined position (S16). The step S14 and successive steps are repeated until the sensor pairs 92*a* determine that all the bills have been accurately positioned in the pooling section 64.

After all the bills have been neatly arranged in the pooling section 61, the shutter 14 is closed. Then, the bill presser 104 is driven toward the picker roller section 102 to urge the bills in the pooling section 61 against the picker rollers 110 by a predetermined pressure. Simultaneously with such a movement of the bill presser 104, the center guide 112 is pulled toward the picker rollers 110 by the tension springs 118 and, therefore, unblocks the opening 107 to communicate the pooling section 64 to the anti-overlap mechanism 106. When the center guide 112 abuts against the stop 120, the picker rollers 110 are ready to feed the bills to the anti-overlap mechanism 106. The drive of the bill presser 104 is stopped when the sensors 138*a* and 138*b* sense the link 136 associated with the bill presser 104. The picker roller section 102 holding the bills between itself and the bill presser 104 starts feeding the bills to the anti-overlap mechanism 106. The anti-overlap mechanism 106 separates one of the bills from the others with the feed roller 140 and reverse roller 142 and drives it out to the transport path 108. The bills sequentially coming out of the transport path 108 are further conveyed to the safe, not shown, of the equipment 1. When all the bills have been fed out of the pooling section 64 as determined by the sensor pairs 90*a*, 90*b* and 91, the apparatus 2 ends the bill feeding operation and assumes the stand-by state to await transactions with another customer.

An alternative embodiment of the present invention will be described hereinafter. This embodiment is essentially the same as the previous embodiment except that the shutter drive mechanism and the shutter lock mechanism share a single drive source, and that the arrangements associated therewith are modified accordingly. Hence, the following description will concentrate only on the shutter drive mechanism and shutter lock mechanism. In the figures, the same components and structural elements are designated by the same reference numerals, and redundant description will be avoided for simplicity.

Figure 10A:
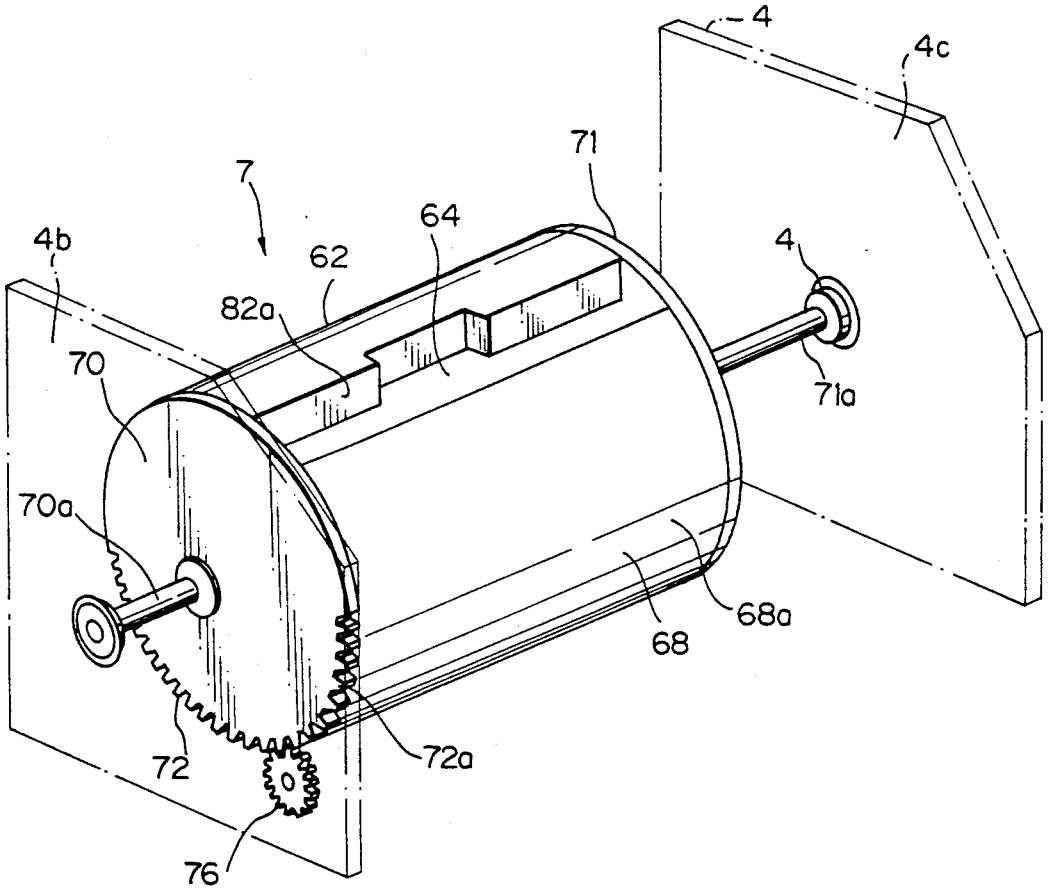
FIG. 10A is a perspective view showing a drum section and a box on which the drum section is mounted in the embodiment.
Figure 10B:
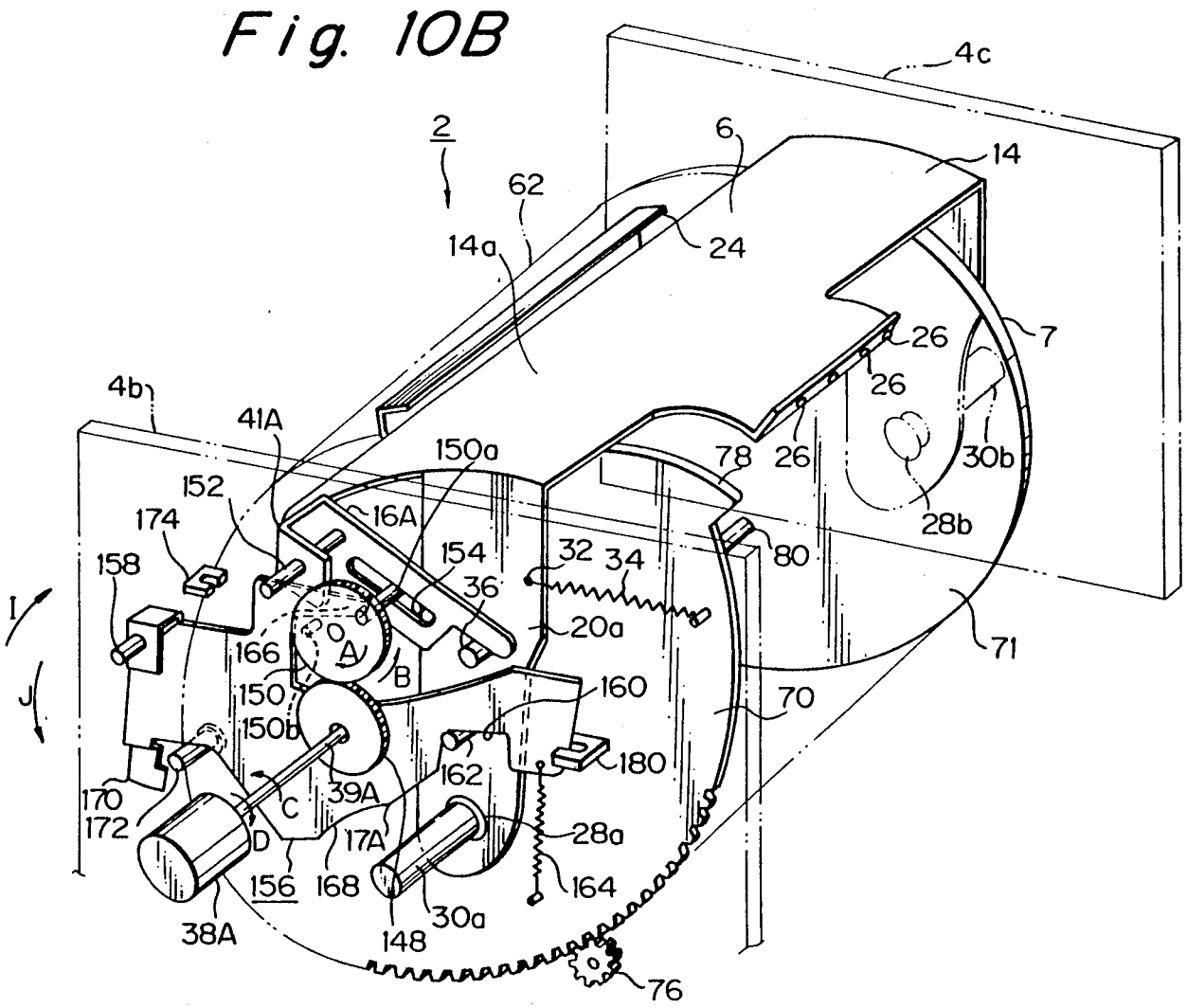
FIG. 10B is a perspective view showing an alternative embodiment of the present invention.

As shown in FIG. 10B, a shutter drive mechanism 16A has a motor 38A, a pinion gear 148 mounted on the output shaft 39A of the motor 38A, a driven gear 150 meshing with the pinion gear 148, and a link 41A connected to the driven gear 150 to transmit the rotation of the motor 38A to the arm 20*a*. The link 41A is supported in such a manner as to be rotatable about a fulcrum 152. A stud 150*a* extending out from the driven gear 150 is received in an elongate slot 154 which is formed through the link 41A. As the driven gear 150 is rotated in a direction indicated by an arrow A in the figure, the stud 150*a* rotates the link 41A clockwise as viewed in FIG. 10. When the free end of the link 41A abuts against the stud 36 provided on the arm 20*a*, the link 41A urges the stud 36 to open the shutter 14 against the action of the spring 34 which is anchored to the arm 20*a* and the box 4. As the driven gear 150 is further rotated in the direction A, the stud 150*a* of the gear 150 moves in the slot 154 in the other direction. As a result, the link 41A is rotated counterclockwise away from the stud 36, causing the shutter 14 to be closed by the tension spring 34. In this manner, the shutter 14 is opened and closed in interlocked relation to the rotation of the driven gear 150. A stud 150*b* is also provided on the driven gear 150 at a predetermined angular distance from the stud 150*a*.

In the previous embodiment, the shutter lock mechanism 17 is mounted on the side wall 4*b* of the box 4 at the opposite side to the customer with respect to the drum 68 and slightly above the axis of rotation of the drum 68. In this alternative embodiment, as also shown in FIG. 10B, a shutter lock mechanism 17A is interposed between the flange 70 of the drum 68 and the side wall 4*b* of the box 4 and constructed to lock the shutter 14 in position on the basis of the relation between a lock bracket 156 thereof and the arm 20*a*. Specifically, the lock bracket 156 is journalled to the side wall 4*b* of the box 4 at a fulcrum 158 which is positioned at the upper left end as viewed in the figure. The lock bracket 156 has a notch 160. When the shutter 14 is closed, a pin 162 studded on the shutter arm 20*a* engages with the notch 160 to lock the shutter 14 in the closed position. The pin 162 is positioned between the stud 36 and the shaft 30*a* of the arm 20*a*. A tension spring 164 is anchored to the lock bracket 156 to constantly bias it downward about the fulcrum 158. Further, the lock bracket 156 has a shoulder 166 at substantially the upper intermediate portion thereof. While the shutter 14 is in an opening movement, the stud 150*b* of the driven gear 150 contacts the shoulder 166 of the lock bracket 156 due to the rotation of the gear 150. Then, the driven gear 150 causes the lock bracket 156 to rotate about the fulcrum 158 against the force of the tension spring 164. An arcuate notch 168 is formed at the lower edge of the lock bracket 156. When the shutter 14 completes the opening movement thereof, the pin 162 studded on the shutter arm 20*a* engages with the edge of the arcuate notch 168 to maintain the position of the lock bracket 156 against the action of the tension spring 164. An extension 170 extends from the lock bracket 156 and is engageable with a pin 172 studded on the flange 70 of the drum section 7 to restrict the rotation of the drum section 7 in a direction indicated by an arrow J. A sensor 174 determines that the shutter 14 is in the open position by sensing the shutter arm 20*a*. A sensor 180 determines that the shutter 14 is in the locked state on sensing the free end of the lock bracket 156.

Figure 11A:
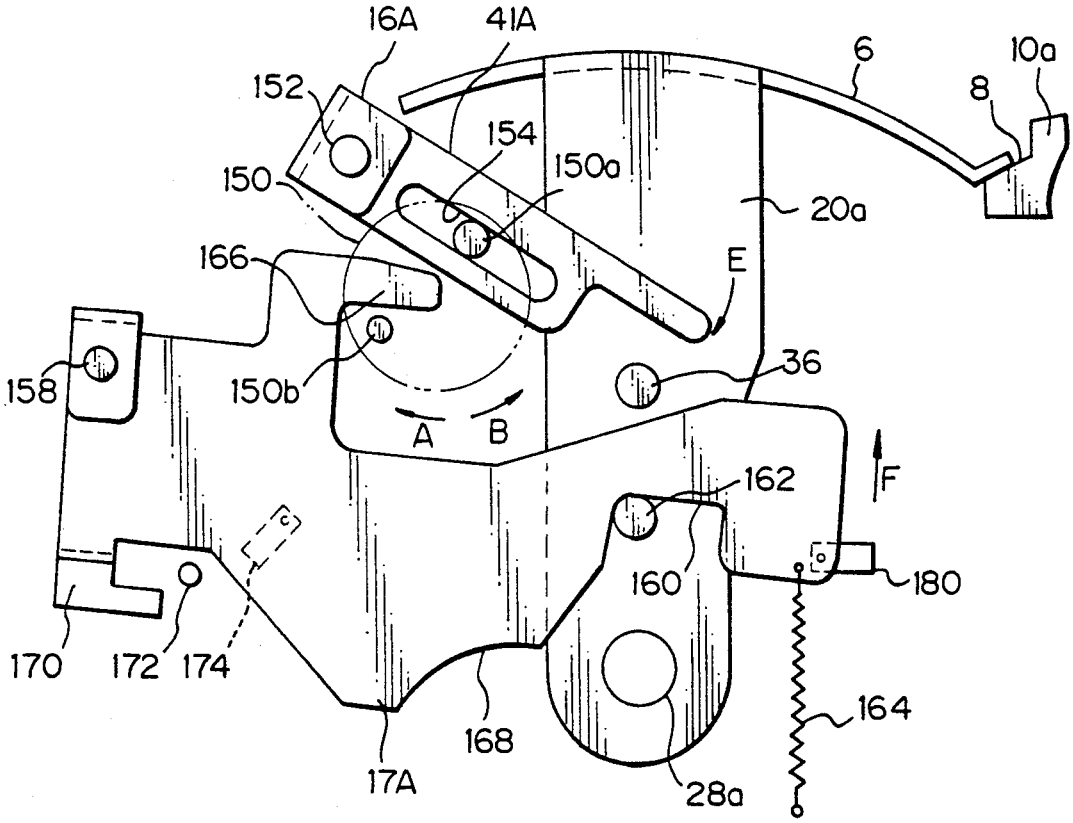
FIGS. 11A through 11C are fragmentary side elevations showing a mechanism for driving the shutter and a mechanism for locking the shutter included in the embodiment of FIG. 10B.
Figure 11B:
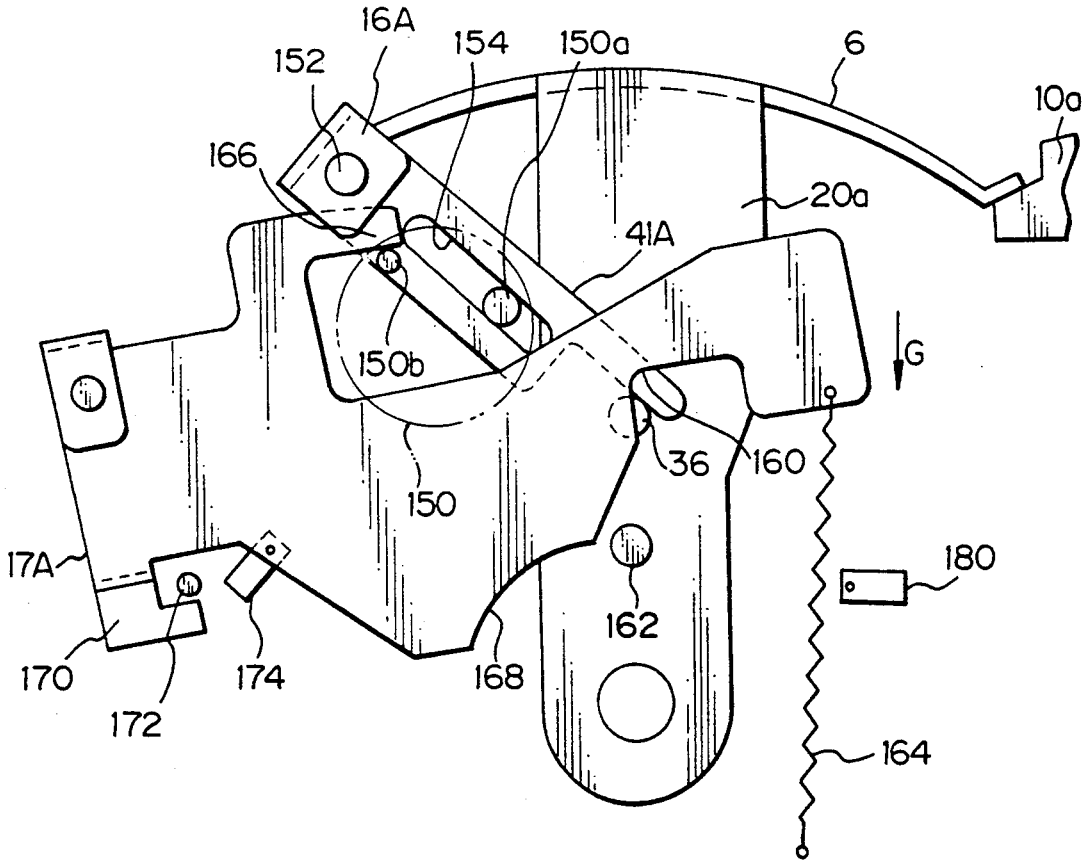
Figure 11C:
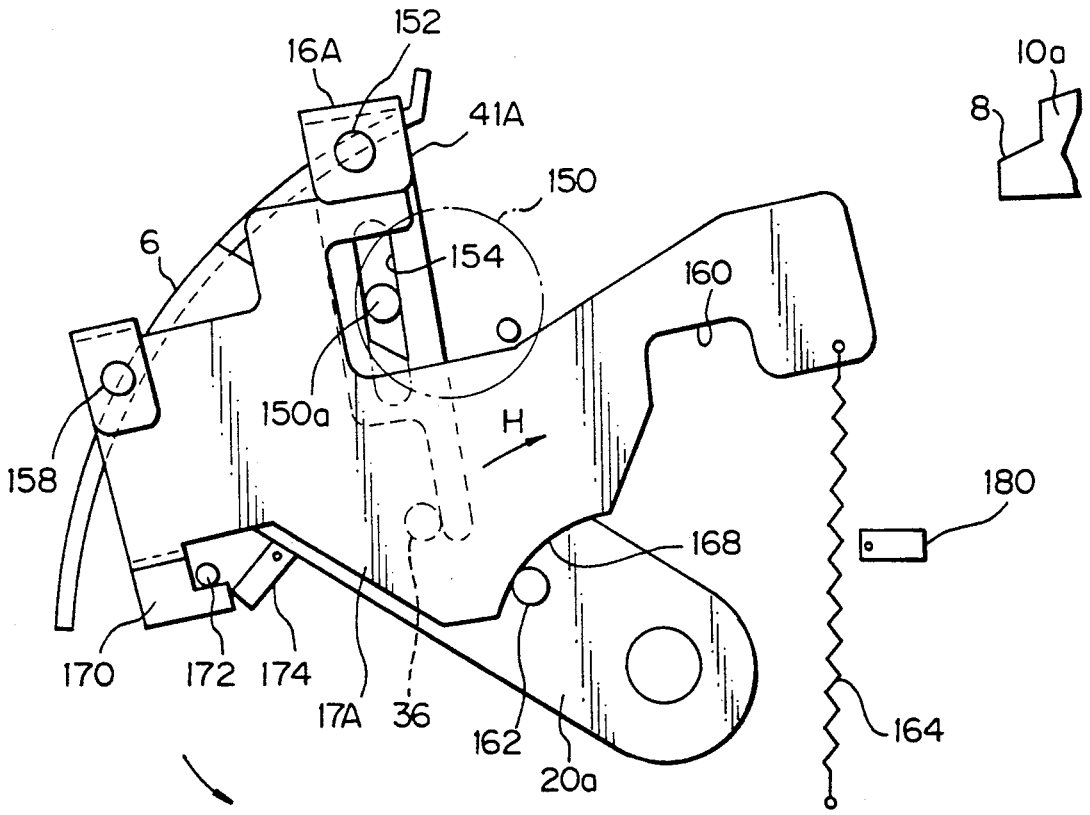
Figure 12A:
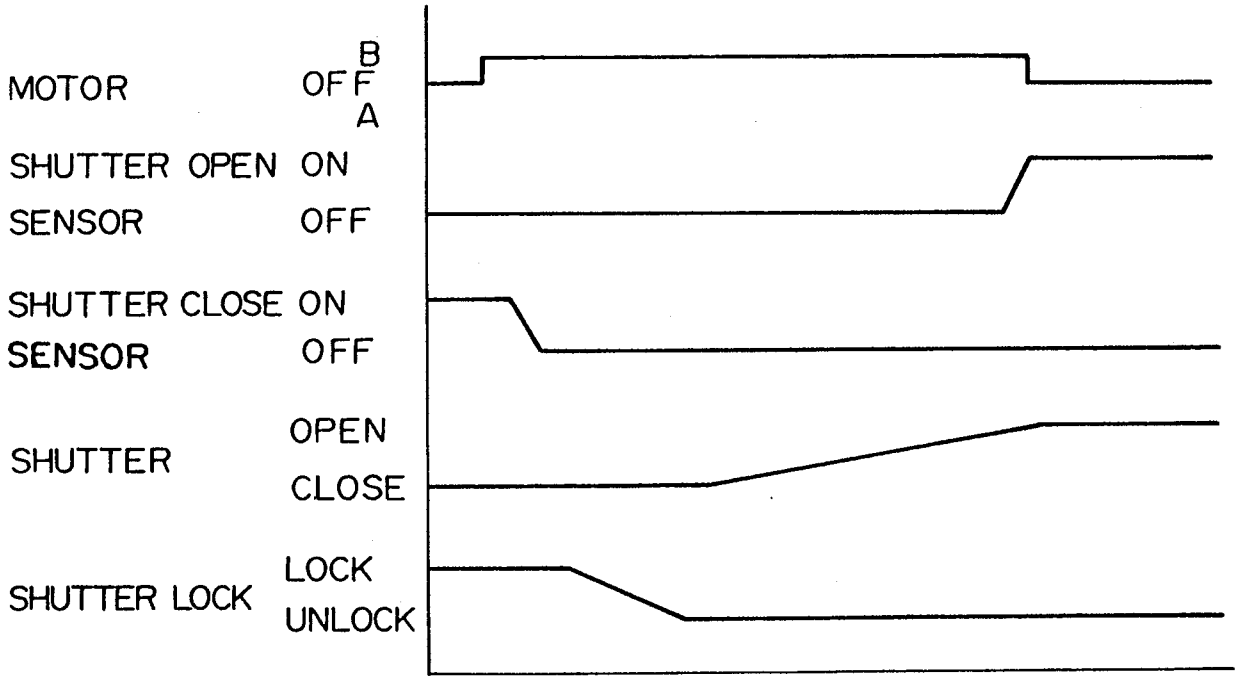
FIGS. 12A and 12B are timing charts demonstrating respectively a shutter opening procedure and a shutter closing procedure of the embodiment shown in FIG. 10B.
Figure 12B:
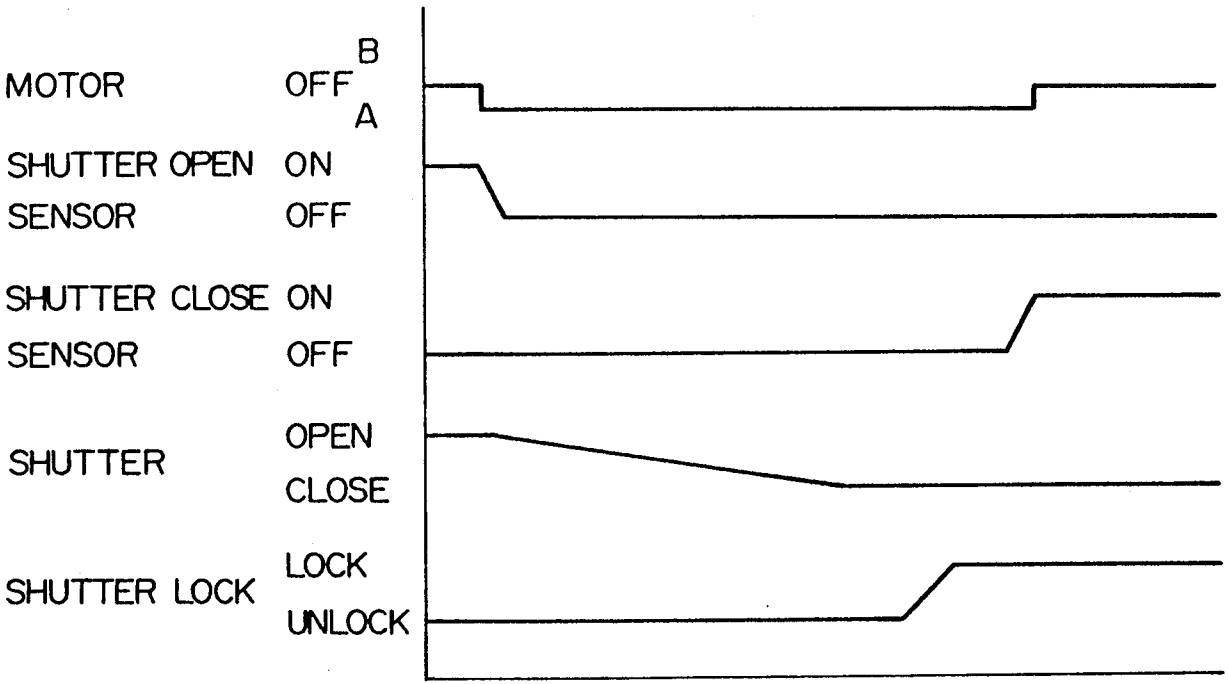

The operation of the alternative embodiment will be described with reference to FIGS. 11A, 11B, 11C, 12A and 12B. Among these figures, FIGS. 12A and 12B are timing charts relating to a shutter closing operation and a shutter opening operation, respectively. First, the positional relation between the link 154 and the lock bracket 156 and driven gear 150 in the closed position of the shutter 14 will be described. As shown in FIG. 11A, the free end of the link 41A is spaced apart from the stud 36 of the arm 20*a* by a predetermined distance. Also, the shoulder 166 of the lock bracket 156 is spaced apart from the stud 150*b* of the driven gear 150 by a predetermined distance. The notch 160 of the lock bracket 156 is so configured as to surely receive the pin 162 of the shutter arm 20*a*, whereby the shutter 14 is surely locked in the closed position. Further, at the time when the closing movement of the shutter 14 completes, the extension 170 of the lock bracket 156 and the pin 172 of the flange 70 are spaced apart from each other by a predetermined gap. This prevents the lock extension 170 from interfering with the drum section 7 when the latter rotates.

When the shutter 14 is to be opened from the fully closed position, the drum section 7 is held in the previously mentioned transaction position to allow the customer's access to the pooling section 64 of the apparatus 2. In this condition, the motor 38A is rotated as indicated by an arrow C in FIG. 10B to in turn rotate the driven gear 150 in a direction indicated by an arrow A. Then, the link 41A is rotated as indicated by an arrow E in FIG. 11A by the stud 150*a* of the driven gear 150. As a result, the free end of the link 41A abuts against the stud 36 of the shutter arm 20*a*, as shown in FIG. 11B. As the motor 38A is further rotated, the link 41A urges the stud 36 and thereby moves the shutter 14 in the opening direction until the sensor 174 senses the shutter arm 20*a*, as shown in FIG. 11C. The position where the sensor so senses the shutter arm 20*a* will be referred to as an end-of-opening position. The motor 38A is deenergized when the sensor 174 senses the end-of-opening position of the shutter 14.

While the shutter 14 is in an opening movement as stated above, the lock bracket 156 moves to unlock the shutter 14, as follows. When the shutter 14 moves from the closed position shown in FIG. 11A toward the position shown in FIG. 11B where the link 41A abuts against the stud 36, the stud 150*b* of the driven gear 150 abuts against the shoulder 166 of the lock bracket 156 due to the rotation of the gear 150. As the motor 38A is further rotated, the stud 150*b* urges the shoulder 166 upward and thereby causes the lock bracket 156 to rotate about the fulcrum 158 in a direction indicated by an arrow F in FIG. 11A. Consequently, the pin 162 of the shutter arm 20*a* is released from the notch 160 of the lock bracket 156, so that the shutter 14 is unlocked and ready to move in the opening direction. More specifically, as shown in FIG. 11B, when the link 41A contacts the stud 36, the pin 162 has been fully released from the notch 160 of the lock bracket 156. Stated another way, the shutter 14 is unlocked before starting its opening movement, as shown in FIG. 12A. This allows the shutter 14 to surely open. As the shutter 14 is moved away from the closed position, the stud 150*b* of the driven gear 150 leaves the shoulder 166 of the lock bracket 156 due to the rotation of the gear 150. Then, the lock bracket 156 tends to rotate as indicated by an arrow G in FIG. 11B due to the action of the tension spring 164. However, the pin 162 of the shutter arm 20*a* is rotated counterclockwise together with the shutter 14 until it contacts the edge of the arcuate notch 168 of the lock bracket 156, preventing the lock bracket 156 from moving in the above-mentioned direction G. It should be noted that the arcuate notch 168 is shaped to be concentric with the pin 162 so as not to effect the movement of the shutter 14.

As the sensor 174 determines that the shutter 14 has been fully opened to the position shown in FIG. 11C, the motor 38A driving the gear 150 is deenergized to complete the operation for opening the shutter 14. Further, as the opening movement of the shutter 14 proceeds, the extension 172 of the lock bracket 156 starts engaging with the pin 172 of the flange 70. In the position shown in FIG. 11C, the extension 172 is fully engaged with the pin 172 to limit the rotation of the drum section 7 in a direction indicated by an arrow J in FIG. 10A while the shutter 14 is open.

To close the shutter 14, in the condition shown in FIG. 11C, the driven gear 150 is rotated in the opposite direction to the previously stated direction, as indicated by an arrow B in FIG. 10B. Then, the link 41A is rotated in a direction indicated by an arrow H in FIG. 11C, sequentially reducing the pressure force acting on the stud 36. Since the shutter 14 is constantly biased in the closing direction by the spring 34, the former is moved in the closing direction by the latter as the pressure force acting on the stud 36 decreases as stated above. Such a condition is shown in FIG. 12B. As shown in FIG. 11A, when the shutter 14 is fully closed with the edge 14*c* thereof abutting against the shutter stop 10*a*, the free end of the link 41A is spaced apart from the stud 36. As the shutter 14 is moved in the closing direction, the pin 162 studded on the shutter arm 20*a* is released from the arcuate notch 168 of the lock bracket 156. As a result, the lock bracket 156 is rotated by the tension spring 164 in a direction indicated by an arrow G in FIG. 11B. When the shutter 14 is brought to the position shown in FIG. 11A where the shutter 14 abuts against the shutter stop 10*a*, the pin 162 is received in the notch 160 of the lock bracket 156 to lock the shutter 14 in the closed position. The sensor 180 determines that the shutter 14 has been locked in position by sensing the right end or free end of the lock bracket 156. In response to the resultant output of the sensor 180, the rotation of the motor 38A and, therefore, that of the driven gear 150 is stopped to end the operation for closing the shutter 14.

It is to be noted that the illustrative embodiments shown and described are applicable not only to a cash handling apparatus but also to other various mechanisms of the type opening and closing a shutter and needing a mechanism for locking the shutter.

Figure 14:
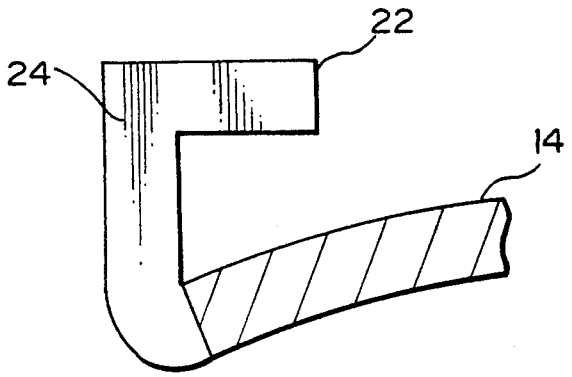
FIG. 14 is a fragmentary side view showing a specific configuration of the anti-intrusion portion.
Figure 14A:
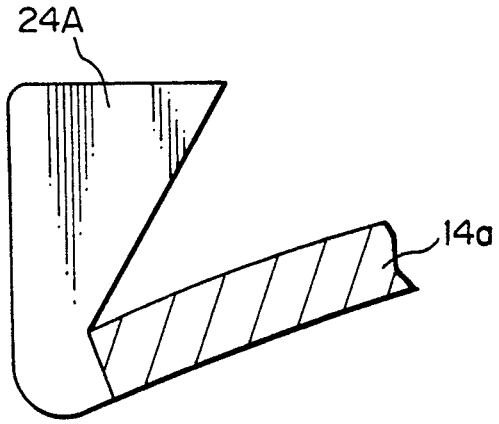
FIG. 14A is a view similar to FIG. 14, showing another specific configuration of the anti-intrusion portion.

FIG. 14A shows a modified form of the anti-intrusion portion which prevents a bill, trash or similar paper strip from being forced into the apparatus 2. As shown, the anti-intrusion portion, generally 24A, resembles the head of a golf club in cross-section. A generally V-shaped space is defined between the portion 24A and the shutter body 14*a* and has an acute angle. The rest of the construction is identical with any one of the embodiments shown and described.

Figure 15A:
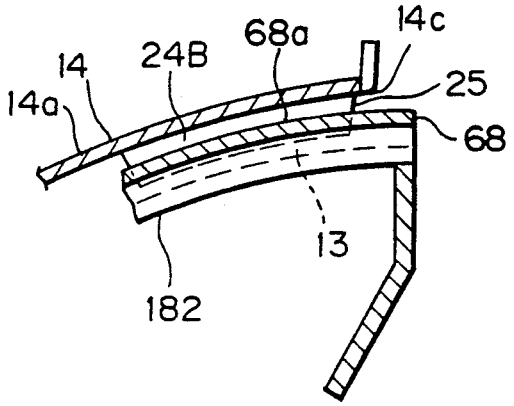
FIG. 15A is a section along line 15A—15A of FIG. 15B, showing another specific configuration of the anti-intrusion portion.
Figure 15B:
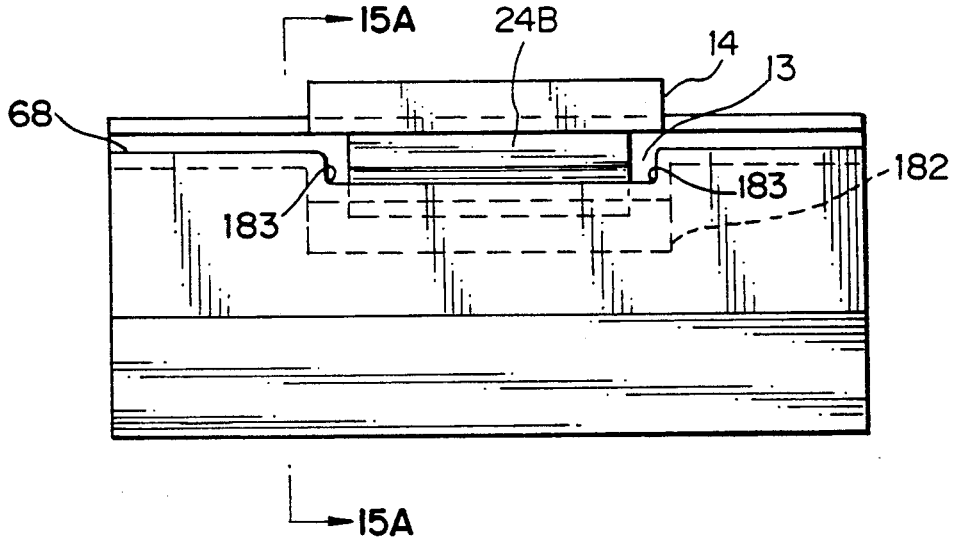
FIG. 15B is a front view of the anti-intrusion portion shown in FIG. 15A.

FIGS. 15A and 15B show another modified form of the anti-intrusion portion. As shown, an anti-intrusion portion 24B is implemented as a projection provided on the underside of the shutter body 14*a* and extending along the leading edge 14*c* of the shutter 14 with respect to the closing direction. A recess 182 is formed in the peripheral surface 68*a* of the drum 68 and mates with the projection 24B when the shutter 14 is fully opened. As shown in FIG. 15B, steps 183 are formed between the shutter body 14*a* and the surface 68*a* of the drum 68 when the projection 24B and recess 182 mate with each other. This is successful in preventing a paper strip such as a bill from intruding entering the apparatus 2 via the clearance 13 defined between the projection 24B and the recess 182. Specifically, should such an anti-intrusion implementation be absent, the clearance 13 between the shutter body 14*a* and the drum periphery would extend simply linearly, as viewed from the front of the apparatus 2. By contrast, in this modification, the gap defined between the anti-intrusion portion 24B and the projection 182 has a stepped configuration in place of the linear configuration. Hence, a bill, trash or similar paper strip cannot enter the apparatus 2 unless it is intentionally deformed imitating the stepped clearance 13. In addition, the anti-intrusion portion 24B has an abutment surface 25 which also prevents a paper strip from being forcibly inserted in the apparatus 2. The rest of the construction is identical with any one of the embodiments shown and described.

Figure 16:
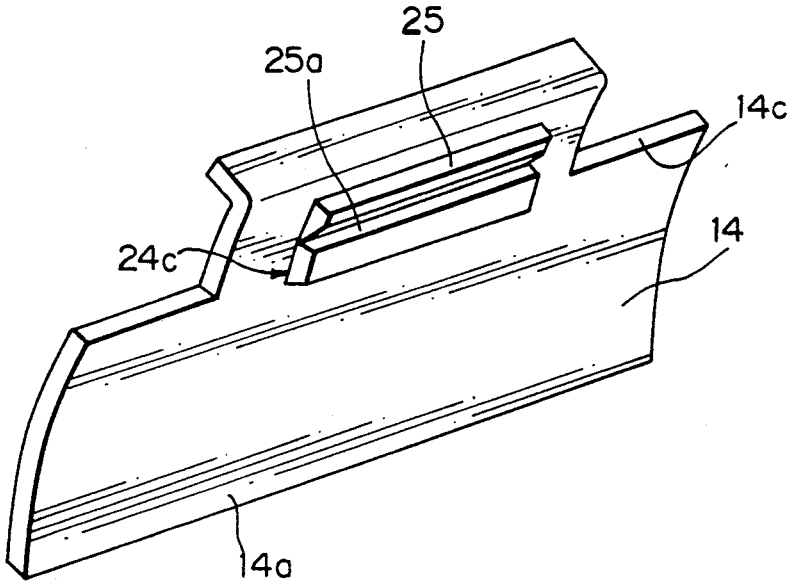
FIG. 16 is a perspective view showing another specific configuration of the anti-intrusion portion.
Figure 17:
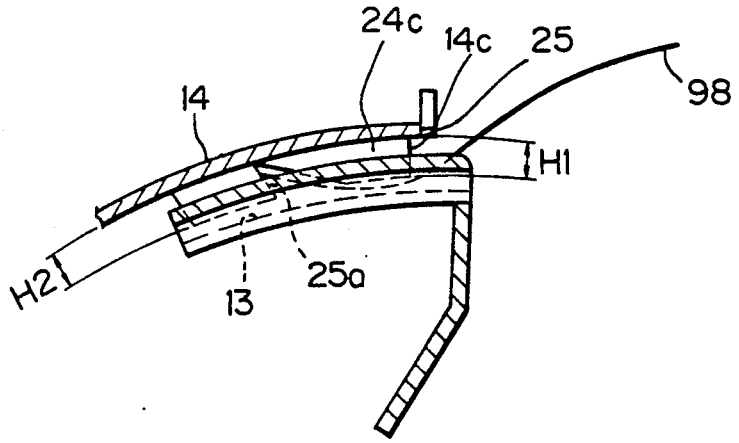
FIG. 17 is a fragmentary side elevation showing a specific condition wherein a bill is prevented from entering the apparatus by the anti-intrusion portion of FIG. 16.

FIGS. 16 and 17 show another modified form of the anti-intrusion portion. As shown, the portion, generally 24C, is formed with a V-shaped groove having an acute angle and extending along the edge 14*c* of the shutter 14 on the underside of the anti-intrusion portion 28B, FIGS. 15A and 15B. The portion 24C, therefore has a second abutment surface 25*a* in addition to the abutment surface 25 of the member 28B. Such a double abutment scheme will further enhance the anti-intrusion effect. Assuming that the first and second abutment surfaces 25 and 25*a* have respectively a height H1 and a height H2, the height H1 is selected to be equal to or smaller than the height H2.

In summary, it will be seen that the present invention provides a paper strip handling apparatus which prevents alien substances from entering it through a clearance formed between a shutter and a box, thereby eliminating troubles ascribable to alien substances. When bills, for example, put in the apparatus by the customer are not neatly positioned and, therefore, caught by the shutter and a stop when the shutter is closed, the apparatus does not start transporting the bills to the subsequent processing stage. This allows the bills to be surely transported without any skew or breakage.

Further, the present invention eliminates the need for independent drive sources in effecting the opening and closing motion and the locking and unlocking motion, thereby cutting down the cost and reducing the overall size of the mechanism. Since the rotation of a drum section is restricted by a limiting section included in a shutter lock mechanism, the apparatus prevents the user's hand from being caught by the drum section and is, therefore, extremely reliable.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. An apparatus for handling strips of paper comprising:

a box formed with a window for receiving strips of paper;

a shutter section for opening and closing said window;

a drum section having a pooling section for temporarily accommodating strips of paper therein; and an anti-intrusion portion provided on a leading edge of said shutter section with respect to a closing direction of said shutter section and having a first abutment surface for preventing an alien substance from being inserted into said apparatus through a clearance formed between said box and said shutter section;

said first abutment surface extending along the leading edge of said shutter section;

a groove being formed at a substantially central part of said anti-intrusion portion to extend along the leading edge of said shutter section to thereby form a second abutment surface.

2. An apparatus in accordance with claim 1, wherein said anti-intrusion portion comprises a plurality of abutment surfaces.

3. An apparatus in accordance with claim 2, wherein the height of said plurality of abutment surfaces sequentially decreases toward the leading edge of said shutter section with respect to said closing direction of said shutter section.

4. An apparatus in accordance with claim 1, wherein said groove has a generally V-shaped cross-section.

5. An apparatus in accordance with claim 1, further comprising a shutter stop section provided in said window to be in contact, when said shutter section is substantially fully closed, with the leading edge of said shutter section with respect to said closing direction of said shutter section, projections being provided on the leading edge of said shutter section, said shutter stop section having recesses formed to mate with the projections.

6. An apparatus in accordance with claim 1, further comprising an abutment provided at one edge of said window, and a contact member being brought into contact with said abutment when said shutter section is substantially fully closed.

7. An apparatus in accordance with claim 1, wherein said shutter section comprises arms extending from opposite side edges of said shutter section and holding said drum section therebetween, said shutter section being rotatably supported by said box via said arms, one of said arms being provided with a projection;

said apparatus further comprising:

a shutter drive mechanism for rotating said shutter section;

a shutter lock mechanism having a notch configured to be engageable with said projection for maintaining said shutter section in a closed position, and an arcuate engaging portion engageable with said projection for maintaining said shutter section in an open position; and a drive source for driving said shutter lock mechanism and said shutter drive mechanism interlocked relation to each other.

8. An apparatus in accordance with claim 7, wherein said shutter lock mechanism comprises a restriction portion for restricting the rotation of said drum section when said shutter section is in the open position.

9. An apparatus in accordance with claim 5 further comprising an abutment provided at one edge of said window, and a contact member being brought into contact with said abutment when said shutter section is substantially fully closed.

10. An apparatus in accordance with claim 5 wherein said shutter section comprises arms extending from opposite side edges of said shutter section and holding said drum section therebetween, said shutter section being rotatably supported by said box via said arms, one of said arms being provided with an additional projection;

said apparatus further comprising:

a shutter drive mechanism for rotating said shutter section between an open position in which said window is open and a closed position in which said window is closed;

a shutter lock mechanism having a notch configured to be engageable with said additional projection for maintaining said shutter section in the closed position, and an arcuate engaging portion engageable with said additional projection for maintaining said shutter section in the open position; and a drive source for driving said shutter lock mechanism and said shutter drive mechanism in an interlocked relation to each other.

11. An apparatus in accordance with claim 6 wherein said shutter section comprises arms extending from opposite side edges of said shutter section and holding said drum section therebetween, said shutter section being rotatably supported by said box via said arms, one of said arms being provided with a projection;

said apparatus further comprising:

a shutter drive mechanism for rotating said shutter section between an open position in which said window is open and a closed position in which said window is closed;

a shutter lock mechanism having a notch formed to be engageable with said projection for maintaining said shutter section in the closed position, and an arcuate engaging portion engageable with said projection for maintaining said shutter section in the open position; and a drive source for driving said shutter lock mechanism and said shutter drive mechanism in an interlocked relation to each other.

12. An apparatus in accordance with claim 9 wherein said shutter section comprises arms extending from opposite side edges of said shutter section and holding said drum section therebetween, said shutter section being rotatably supported by said box via said arms, one of said arms being provided with an additional projection;

said apparatus further comprising:

a shutter drive mechanism for rotating said shutter section between an open position in which said window is open and a closed position in which said window is closed;

a shutter lock mechanism having a notch configured to be engageable with said additional projection for maintaining said shutter section in the closed position, and an arcuate engaging portion engageable with said additional projection for maintaining said shutter section in the open position; and a drive source for driving said shutter lock mechanism and said shutter drive mechanism in an interlocked relation to each there.

13. An apparatus in accordance with claim 10 wherein said shutter lock mechanism comprises a restriction portion for restricting a rotation of said drum section when said shutter section is in the open position.

14. An apparatus in accordance with claim 11 wherein said shutter lock mechanism comprises a restriction portion for restricting a rotation of said drum section when said shutter section is in the open position.

15. An apparatus in accordance with claim 12 wherein said shutter lock mechanism comprises a restriction portion for restricting a rotation of said drum section when said shutter section is in the open position.

16. An apparatus for handling strips of paper comprising:

a box formed with a window for receiving strips of paper;

a shutter section for opening and closing said window;

a drum section having a pooling section for temporarily accommodating strips of paper therein;

an anti-intrusion portion provided on either one of opposite edges of said shutter section with respect to an opening and a closing direction of said shutter section and having an abutment surface for preventing an alien substance form being inserted into said apparatus through a clearance formed between said box and said shutter section;

a shutter stop section provided in said window to be in contact, when said shutter section is substantially fully closed, with a leading one of the opposite edges of said shutter section with respect to the closing direction of said shutter section; and projections being provided on the leading edge of said shutter section; said shutter stop section having recesses formed to mate with the projections.

17. An apparatus for handling strips of paper comprising:

a box formed with a window for receiving strips of paper;

a shutter section for opening and closing said window;

a drum section having a pooling section for temporarily accommodating strips of paper therein;

an anti-intrusion portion provided on a leading edge of said shutter section with respect to an opening direction of said shutter section and having an abutment surface for preventing an alien substance form being inserted into said apparatus through a clearance formed between said box and said shutter section;

an abutment provided at one edge of said window; and a contact member being brought into contact with said abutment when said shutter section is substantially fully closed.

18. An apparatus for handling strips of paper comprising:

a box formed with a window for receiving strips of paper;

a shutter section for opening and closing said window;

a drum section having a pooling section in which a strip of paper is temporarily kept, and an anti-intrusion portion provided on either of opposite edges of said shutter section with respect to an opening and a closing direction of said shutter section and having an abutment surface by which an alien substance is prevented from being inserted into said apparatus through a clearance formed between said box and said shutter section;

said shutter section comprising arms extending from opposite side edges of said shutter section and holding said drum section therebetween, said shutter section being rotatably supported by said box via said arms, one of said arms being provided with a projection;

said apparatus further comprising:

a shutter drive mechanism for rotating said shutter section between an open position in which said window is open and a closed position in which said window is closed;

a shutter lock mechanism having a notch formed to be engageable with said projection for maintaining said shutter section in the closed position, and an arcuate engaging portion engageable with said projection for maintaining said shutter section in the open position;

a drive source for generating driving power; and linkage means for operably engaging said drive source with said shutter lock mechanism and said shutter drive mechanism to convey the driving power generated by said drive source to said shutter lock mechanism and said shutter drive mechanism to drive said shutter lock mechanism and said shutter section in an interlocked relation to each other.

19. An apparatus in accordance with claim 18 wherein said shutter lock mechanism comprises a restriction portion for restricting rotation of said drum section when said shutter section is in the open position.

* * * * *